US006053599A

United States Patent [19]

Maeda

[11] Patent Number: 6,053,599

[45] **Date of Patent: *Apr. 25, 2000**

[54] LIQUID JET PRINTING HEAD AND PRINTING APPARATUS HAVING THE LIQUID JET PRINTING HEAD

[75] Inventor: Hiroyuki Maeda, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/829,873

[22] Filed: Apr. 2, 1997

Related U.S. Application Data

[63] Continuation of application No. 08/280,383, Jul. 25, 1994, abandoned.

[30] Foreign Application Priority Data

Jul. 26, 1993 [JP] Japan ..... 5-184223

[51] Int. Cl.[7] ..... B41J 2/05

[52] U.S. Cl. ..... 347/65; 347/94

[58] Field of Search ..... 347/65, 63, 62, 347/56

[56] References Cited

U.S. PATENT DOCUMENTS

| | | | |
|---|---|---|---|
| 4,313,124 | 1/1982 | Hara | 347/57 |
| 4,317,124 | 2/1982 | Shirato et al. | 347/67 |
| 4,345,262 | 8/1982 | Shirato et al. | 347/57 |
| 4,463,359 | 7/1984 | Ayata et al. | 347/56 |
| 4,502,060 | 2/1985 | Rankin et al. | 347/65 |
| 4,723,129 | 2/1988 | Endo et al. | 347/56 |
| 4,740,796 | 4/1988 | Endo et al. | 347/56 |
| 5,041,844 | 8/1991 | Deshpande | 347/65 |
| 5,103,246 | 4/1992 | Dunn | 347/58 |
| 5,159,354 | 10/1992 | Hirasawa | 347/65 |
| 5,745,129 | 4/1998 | Moriyama et al. | 347/12 |

FOREIGN PATENT DOCUMENTS

| | | | |
|---|---|---|---|
| 436047 | 2/1991 | European Pat. Off. | B41J 2/055 |
| 0 436 047 | 7/1991 | European Pat. Off. | B41J 2/055 |
| 0436889 | 7/1991 | European Pat. Off. | B41J 2/16 |
| 0484983 | 5/1992 | European Pat. Off. | B41J 2/135 |
| 0495648 | 7/1992 | European Pat. Off. | B41J 2/05 |
| 0600748 | 6/1994 | European Pat. Off. | B41J 2/16 |
| 55-100169 | 7/1980 | Japan | B41J 3/04 |
| 59-138460 | 8/1984 | Japan | B41J 3/04 |
| 60-18352 | 1/1985 | Japan | B41J 3/04 |
| 61-37438 | 2/1986 | Japan | B41J 3/04 |
| 61-59914 | 12/1986 | Japan | B41J 3/04 |
| 63-197649 | 8/1988 | Japan | B41J 3/04 |
| 2-283453 | 11/1990 | Japan | B41J 2/05 |
| 3-34467 | 5/1991 | Japan | B41J 2/05 |
| 4-211950 | 8/1992 | Japan | B41J 2/05 |
| 4-250051 | 9/1992 | Japan | B41J 2/05 |
| 4-292949 | 10/1992 | Japan | B41J 2/05 |

*Primary Examiner*—Joseph Hartary
*Attorney, Agent, or Firm*—Fitzpatrick, Cella, Harper & Scinto

[57] ABSTRACT

A printing head designed to have a long life, particularly to be able to maintain a long duration life of a heater portion and improved qualities of printed images with improved stability and to achieve high-speed printing, a printing apparatus using the printing head and a method for driving the printing head are provided. On a substrate of the printing head are formed a printing liquid supply chamber, liquid channels communicating with the supply chamber, liquid channel wall members forming the channels, nozzles for ejecting a liquid, heaters provided as thermal energy transducing elements in the channels, and an electric wiring for energizing the heaters. Each channel has a wing-like sectional configuration in the vicinity of the corresponding heater.

24 Claims, 26 Drawing Sheets

FIG. 6
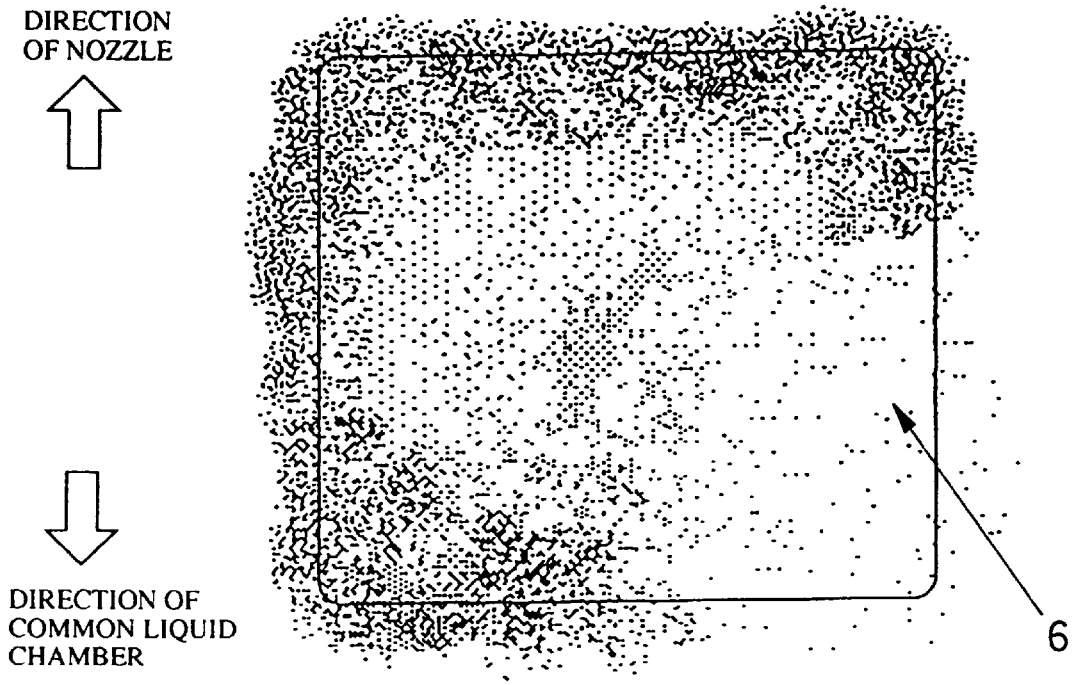
FIG. 7 - PRIOR ART
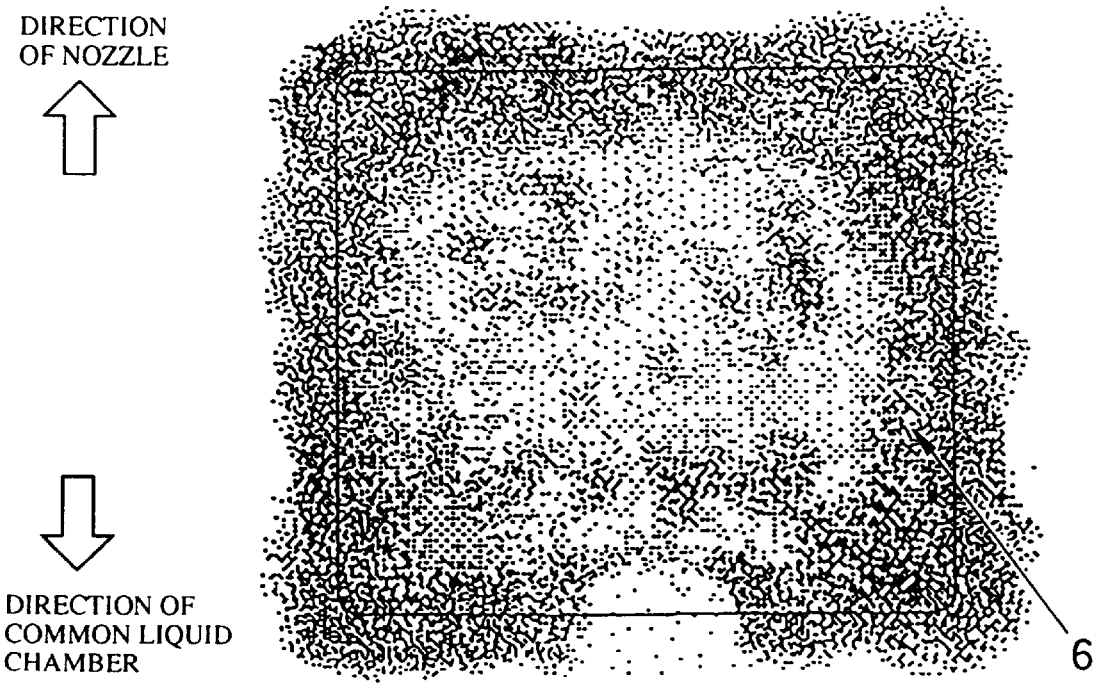

LIQUID JET PRINTING HEAD AND PRINTING APPARATUS HAVING THE LIQUID JET PRINTING HEAD

This application is a continuation, of application Ser. No. 08/280,383 filed Jul. 25, 1994, which is now abandoned.

BACKGROUND OF THE INVENTION

1. Field of the Invention

This invention relates to a liquid-jet printing head which operates for printing by ejecting a printing liquid by utilizing thermal energy so that a flying droplet of the printing liquid is formed, and a liquid-jet printing apparatus having the liquid-jet printing head. The present invention is applied to printing of ink on various ink supporting members (recording members), such as cloth, strings, paper, and other sheet-like members, and to various information processors or to printers provided as output units of information processors.

2. Description of the Related Art

In liquid-jet printing systems, various means are used to eject a printing liquid such as ink through a head so that the ejected ink is attached to an ink supporting member such as paper, thereby performing printing.

Low-noise, high-speed and high-density printing can be achieved if a liquid-jet printing apparatus using this kind of printing system is used. Moreover, such a printing apparatus can be reduced in size and can be mass-produced easily and at a low cost, because it requires no development and fixation steps with respect to plain paper. Liquid-jet printing apparatuses have attracted attention because of these advantages.

In particular, on-demand type liquid-jet printing apparatuses do not require a high-voltage generating unit and an unnecessary-ink recovery unit, such as those required by continuous type liquid-jet printing apparatuses, and can, therefore, be reduced in overall size. It is therefore believed that they will find promising applications.

Among apparatuses of this kind, a liquid-jet printing apparatus having a liquid-jet printing head as disclosed in Japanese Patent Publication No. 61-59914, has attracted a great deal of attention. In this printing head, a liquid channel filled with a liquid is heated to abruptly form a bubble therein. With the increase in the volume of the bubble, the pressure of the liquid is increased so that a droplet of the liquid is ejected through an outlet communicating with the liquid channel to fly and attach to an ink supporting member, thus performing printing. Specifically, this liquid-jet printing head can easily be designed so as to have a multiplicity of nozzles provided at high density. Therefore, an increase in printing speed and an improvement in image quality can be achieved by adopting a lengthwise head arrangement.

In general, a liquid-jet printing head utilizing thermal energy to form a flying droplet of a printing liquid has a printing liquid heating means having a thermal energy transducer including a heating resistor element (hereinafter referred to as "heater") capable of developing heat to heat the printing liquid when an electric signal is applied to the element, and electrodes for applying the electric signal to the heating resistor element.

A printing liquid generally used for printing with liquid-jet printing apparatuses is a water-based printing liquid formed of printing components, such as pigments or dyestuffs, and a solvent component which is water or a mixture of water and a water-soluble organic solvent and in which the printing components are dissolved or dispersed.

A heating limit temperature at which such a water-based printing liquid is abruptly evaporated, i.e., a temperature at which vapor is generated at a gas-liquid interface by heat conducted through a very thin and stable vapor film formed between the electric heating surface and the liquid, is 250° to 350° C. Therefore, if a printing liquid having such a temperature characteristic is used for printing on a printing member in such a manner that an electric signal is applied to a heater to form a bubble in the printing liquid such that a flying droplet of the printing liquid is formed, the heater is heated from an ambient temperature to a temperature of 300° to 800° C. each time the electric signal is applied.

Recently, there has been a demand for a method or means for efficiently utilizing energy of a bubble formed as described above in order to further increase the liquid passage density and the number of liquid outlets. Japanese Patent Laid-Open Publication No. 4-211950 discloses a liquid passage structure in which the width of each of the liquid passages in the direction of arrangement of the liquid passages in a printing head has a maximum value between the corresponding outlet and an end of a thermal energy transducing element on the side of a supply port, and is monotonically reduced from the vicinity of the maximum value toward each of the outlet and the supply port through a certain passage portion, the reduction rate on the nozzle side being higher.

However, even if energy of a bubble can be efficiently utilized to eject of a printing liquid, the life of a printing head and the qualities of printed images are influenced by a cavitation collapse pressure which acts to erode a heater or a channel portion around the heater when a bubble caused by heating the printing liquid collapses, as long as the printing head is constructed to heat the printing liquid by repeatingly energizing the heater at a high temperature by electrical signals so that bubbles are formed in the printing liquid to eject droplets of the printing liquid. Therefore, design efforts have been made to reduce such an erosion effect.

For example, Japanese Patent Laid-Open Publication No. 59-138460 discloses a method of moving the position at which a bubble collapses out of the area of a heater to prevent erosion caused by cavitation collapse pressure by prescribing a certain positional relationship between the heater and a liquid channel portion which is formed in the vicinity of the heater so that the channel width is not constant.

Japanese Patent Publication No. 3-34467 discloses a liquid channel structure in which a rotational motion of a printing liquid is caused when the printing liquid flows into a liquid channel. Cavitation collapse pressure energy is consumed by the thermal motion to prevent heaters from being eroded by the cavitation collapse pressure.

Japanese Patent Laid-Open Publication No. 4-250051 discloses a method of providing a fluid resistance portion for minimizing the sectional area of a printing liquid channel wall upstream of a thermal energy transducing element. A bubble is thereby divided so that the energy of the bubble when the bubble collapses is reduced, thereby preventing erosion of the heater caused by cavitation collapse pressure.

Further, Japanese Patent Publication No. 4-292949 discloses a structure in which a passage surface located upstream of a thermal energy transducing element and facing a substrate portion on which the thermal energy transducing element is provided has a surface configuration such as to be formed of, from the upstream side, a first surface formed so as to monotonically reduce the sectional area of the printing liquid channel, and a second surface formed so as to monotonically increase the sectional area. In this structure, the position at which a bubble collapses, i.e., the position at which the maximum cavitation collapse pressure acts on a heater is separated from the heater surface, thereby preventing erosion of the heater caused by cavitation collapse pressure.

In the case of the art of Japanese Patent Laid-Open Publication No. 59-138460, erosion of a heater can be prevented, as described above, but the problem of breakage of a substrate, electrodes and other portions due to concentration of erosion action is encountered, since no means has been provided to prevent concentration of cavitation collapse pressure at portions other than the heater.

In the case of the art of Japanese Patent Laid-Open Publication No. 4-250051, and Japanese Patent Publication Nos. 3-34467 and 4-292949, the erosion action of cavitation collapse pressure upon a heater can be reduced or eliminated, but deposits from the liquid, generated by cycles of high-temperature heating of the heater to attach to the heater surface, cannot be easily separated from the heater surface.

If such deposits advances are not removed and if the deposition advances, the transmission of energy from the heater to the liquid becomes unstable and, accordingly, liquid ejection characteristics become unstable, resulting in a disturbance in image formation. Thus, there is a risk of a considerable reduction in the life of the head. The influence of deposits on the heater surface becomes greater if the size of the heater is reduced in order to achieve a high-density liquid passage arrangement.

SUMMARY OF THE INVENTION

In view of these problems, an object of the present invention is to provide a printing head and an ink jet printing apparatus capable of constantly maintaining good stable ink ejection conditions, and obtaining high-quality images with reduced ejection characteristic dispersions between printing heads for a long time in comparison with the conventional art. This effect is achieved by dispersively distributing over the heater surface the erosion action of cavitation collapse pressure caused when a bubble collapses. The erosion action is thereby utilized to separate deposits from a large area of the heater surface without damaging a peripheral portion of the thermal energy transducer.

Another object of the present invention is to provide a printing head and an ink jet printing apparatus designed to achieve high-speed printing by adopting a printing passage structure for a reduction in the time taken to refill printing liquid channels.

To achieve these objects, according to one aspect of the invention, there is provided a printing head for performing printing by ejecting a liquid, comprising a plurality of heating resistor elements each for generating a bubble in the liquid by applying heat to the liquid, the liquid being ejected through an outlet by the formation of the bubble, a substrate on which the heating resistor elements are disposed, and liquid channels (passages) provided on the substrate in correspondence with the heating resistor elements and communicating with the nozzles and with a common liquid chamber for supplying the liquid, wherein each of the liquid channel parallel is formed so as to have a substantially-wing-like sectional configuration as its sectional configuration defined in the vicinity of the corresponding heating resistor parallel to the substrate, the substantially-wing-like sectional configuration being such that a force is applied to the bubble in a direction intersecting a direction from the common liquid chamber toward the corresponding nozzle.

According to another aspect of the invention, there is provided a method of driving a printing head having heating resistor elements for applying heat to a liquid and liquid channels formed in correspondence with the heating resistor elements, the method comprising the steps of:

generating heat by applying an electrical signal to at least one of the heating resistor elements;

generating a bubble in the liquid by the heat generated by the application of the electrical signal, and ejecting the liquid through a nozzle communicating with the corresponding liquid chamber; and applying a force to the bubble in a direction intersecting a direction from a common liquid chamber toward the corresponding nozzle by a flow of the liquid when the liquid channel is refilled with the liquid from the common liquid chamber simultaneously with a collapse of the bubble.

In this arrangement, the flow of the printing liquid on the periphery of a bubble generated by the thermal energy transducing element in each printing liquid channel is formed asymmetrically so that a pressure imbalance is caused in a region around the bubble. A force is thereby applied to the bubble in a direction intersecting the main direction of the flow of the printing liquid (a direction from the common liquid chamber toward the corresponding nozzle) for refilling the channel. It is therefore possible to provide a printing head capable of preventing concentration at the thermal energy transducing element of the erosion action of cavitation collapse pressure caused when the bubble collapses.

Further, the erosion action upon each thermal energy transducing element is dispersively distributed according to the imbalance of the pressure in the region around the bubble. It is therefore possible to provide a printing head in which deposits on a larger area of the heater can be separated from the heater.

By these effects, it is possible to reduce the instability of energy transmission to the printing liquid so that a good ink ejection condition can be stably maintained and to stably form high-quality printed images for a long time in comparison with the conventional art by limiting dispersions of ejection characteristics of printing heads.

Also, each adjacent pair of spaces having a wing-like sectional configuration is formed symmetrically about a common wall therebetween to form an associated pair of channels, and the length of the common wall is reduced relative to the overall block length. It is therefore possible to provide a printing head in which the printing liquid can flow rapidly from the printing liquid supply chamber into the spaces having the wing-like sectional configuration (printing liquid channels).

High-speed printing can also be achieved by using this pair structure and a driving method for reducing the occurrence of crosstalk between the pair structures.

BRIEF DESCRIPTION OF THE DRAWINGS

FIG. 6 is a sketch drawn by observing the influence of the erosion action of cavitation collapse upon a heater portion of the printing head shown in FIG. 1;

FIG. 7 is a sketch drawn by observing a heater portion of the conventional printing head;

DESCRIPTION OF THE PREFERRED EMBODIMENTS

Figure 1:
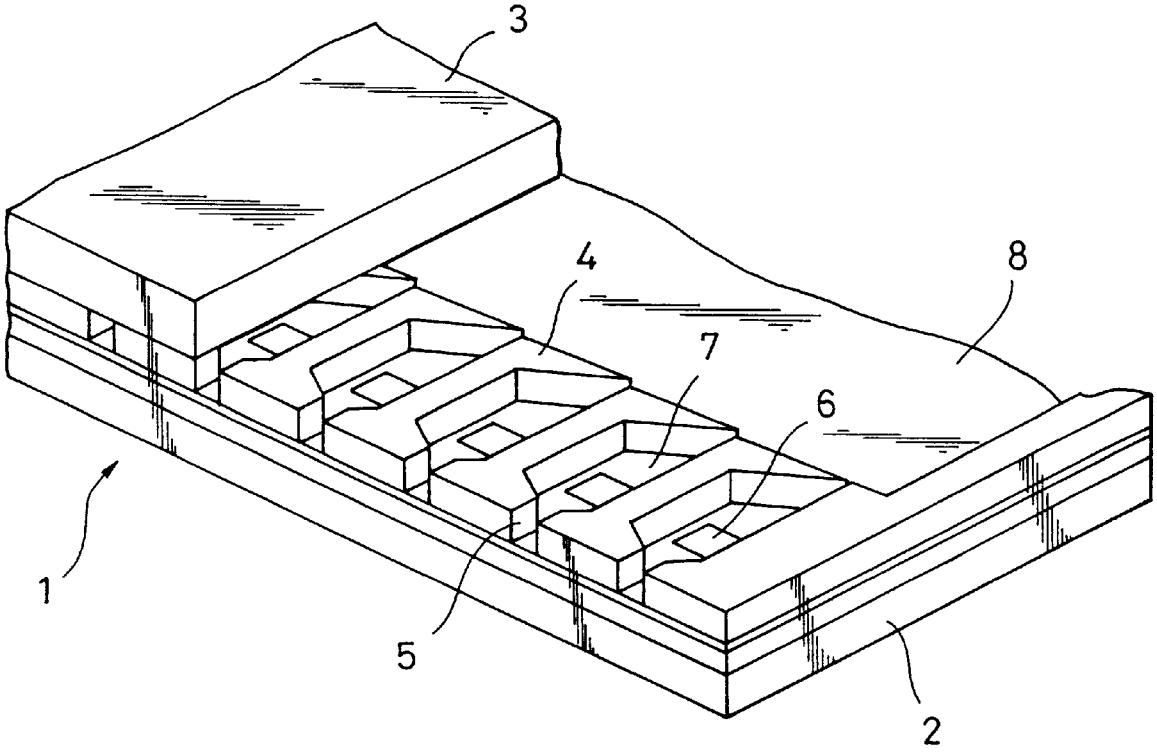
FIG. 1 is a perspective view of a first embodiment of a printing head in accordance with the present invention.
Figure 2A:
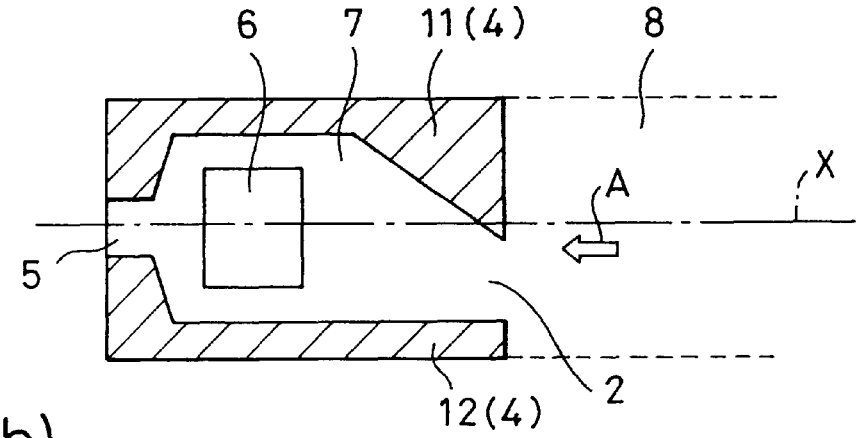
FIGS. 2(*a*) through 2(*d*) are plan views of the ink channel structure of the printing head shown in FIG. 1, showing the ink ejection mechanism.
Figure 2B:
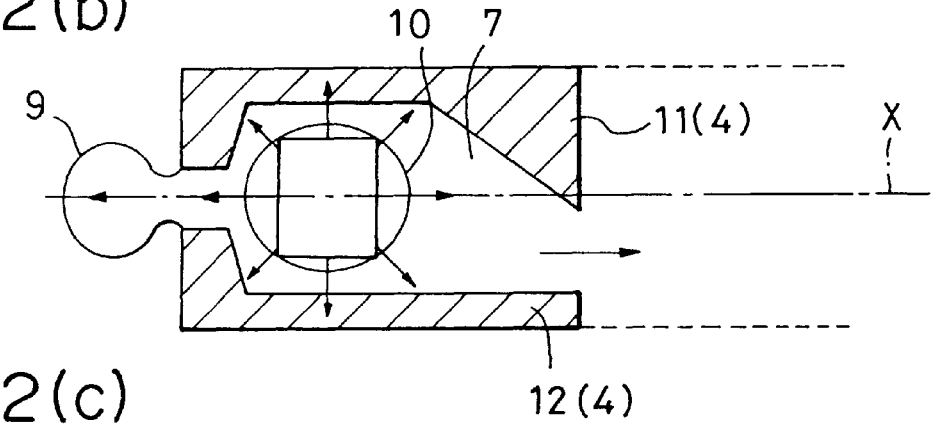
Figure 2C:
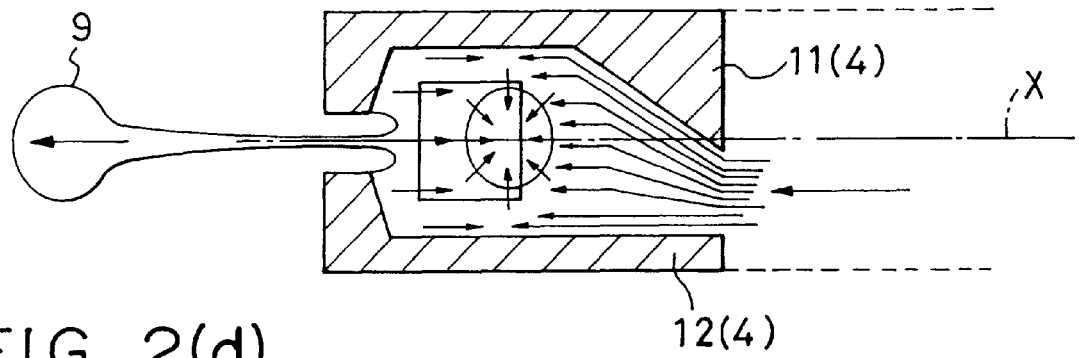
Figure 2D:
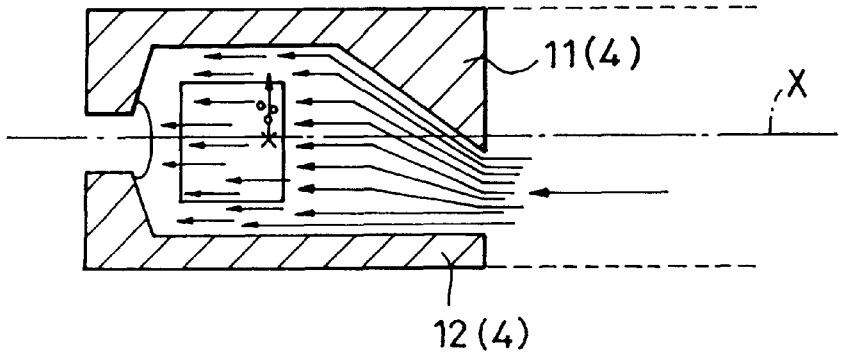
Figure 3A:
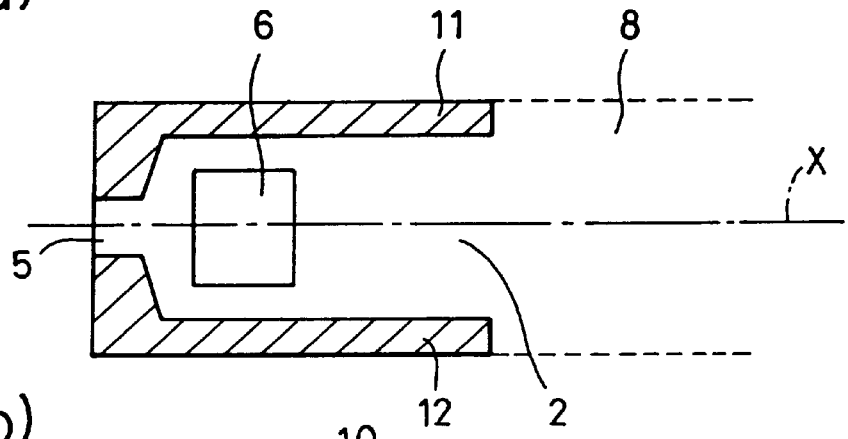
FIG. 3(a) PRIOR ART
FIGS. 3(*a*) through 3(*d*) are plan views of the ink channel structure of a conventional printing head, showing the ink ejection mechanism.
Figure 3B:
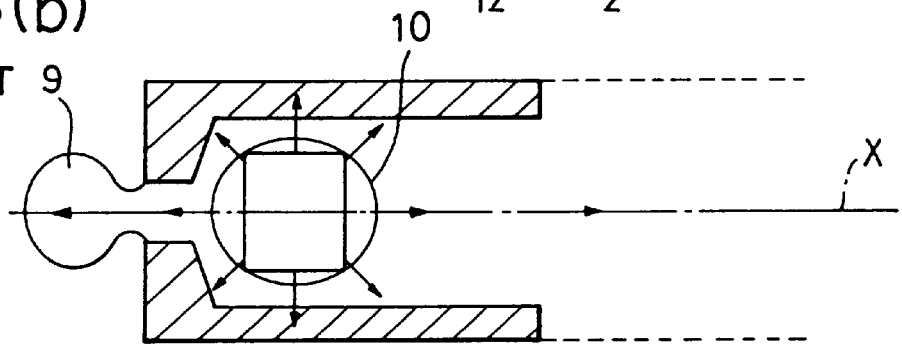
FIG. 3(b) PRIOR ART
Figure 3C:
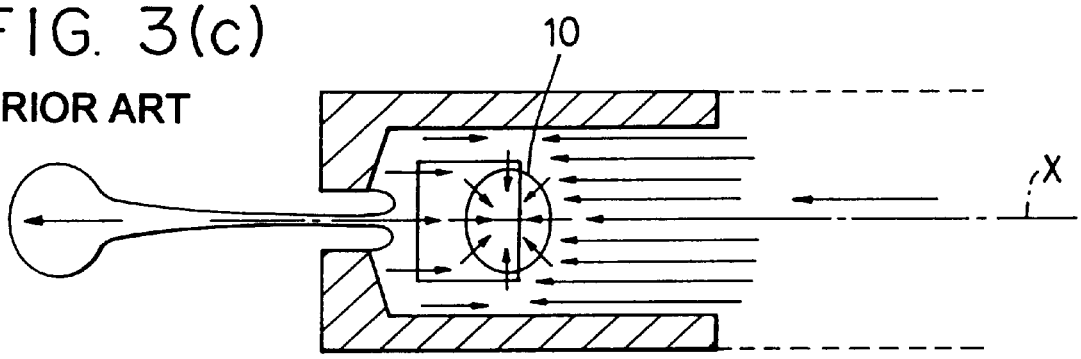
FIG. 3(c) PRIOR ART
Figure 3D:
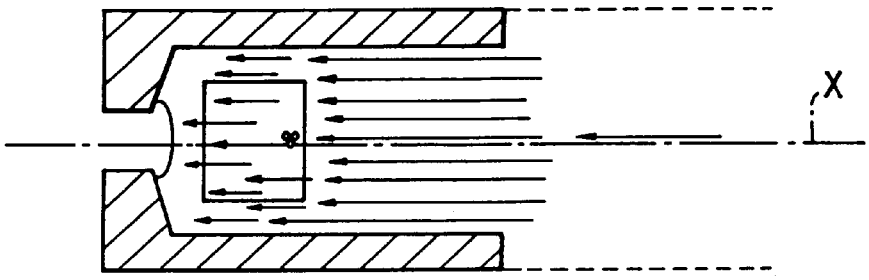
FIG. 3(d) PRIOR ART

The preferred embodiments of the present invention will be described in detail with reference to the accompanying drawings. In the embodiments described below, ink is used as a printing liquid. However, any liquid other than ink may be used as long as it can be ejected by a head of the present invention. FIG. 1 is a perspective view of a first embodiment of a liquid-jet printing head 1 in accordance with the present invention. The printing head 1 has a printing liquid supply chamber (hereinafter referred to as "common liquid chamber") 8, liquid channels (liquid passages; hereinafter referred to as "channels") 7 which communicate with the common liquid chamber 8, liquid channel wall members (hereinafter referred to as "channel wall members") 4, nozzles 5 through which a liquid (represented by ink in the following) is ejected, heating resistor elements (hereinafter referred to as "heaters") 6 provided as thermal energy transducing elements in correspondence with the channels 7, an electric wiring (not shown) for supplying electric power to the heaters 6, and a substrate 2 on which the thermal energy transducing elements and the electric wiring are provided. A top plate 3 is superposed on these components.

The channel wall members 4 have, along a plane parallel to the substrate 2, a sectional configuration such as to form a spacing having a substantially-wing-like sectional configuration in a region in the vicinity of each heater 6. The region in the vicinity referred to herein is a region defined between a channel portion increased in sectional area from the side of the common liquid chamber toward the outlet and the opening of the nozzle on the liquid chamber side. The wing-like sectional configuration is such that when a liquid flows from the common liquid chamber side into each channel, a force is applied to a bubble in a direction intersecting the direction from the liquid chamber to the nozzle. That is, it is defined as such a channel configuration that a force in accordance with the Kutta-Joukowski theorem is applied to a peripheral portion of a bubble. The effect of this arrangement is maximized when the direction of the force is approximately perpendicular to the direction from the liquid chamber to the nozzle.

Printing is performed by using the thus-constructed head 1 as described below. First, the channels 7 are filled with ink from the common liquid chamber 8 (see FIG. 2(*a*)). Next, electrical printing signals are applied to some of the heaters 6 through the electric wiring 6. The heaters 6 are thereby heated and thermal energy is applied from the heaters 6 to the ink existing in the channels 7 in the vicinity of the heaters 6. By this application of thermal energy applied from the heaters 6 to the ink, film boiling is caused to generate a bubble with an instantaneous increase in volume in the ink receiving the thermal energy (see FIG. 2(*b*)). A part of the ink existing on the downstream side of each heater 6 (nozzle 5 side) is ejected through the outlet 5 to form a flying ink droplet 9 (see FIG. 2(*c*)). The ink droplets 9 is attached to an ink supporting member such as paper (not shown) which has been fed to a position in front of the printing head 1, thereby printing a desired image (see FIG. 2(*d*)).

The difference between this embodiment and a conventional printing head will be described with reference to FIGS. 2(*a*) to 2(*d*) and FIGS. 3(*a*) to 3(*d*) illustrating an example of the conventional art.

FIG. 2(*a*) and FIG. 3(*a*) are schematic plan views of the printing heads showing states where liquid channels are filled with ink. As is apparent from these figures, the channel wall members 4 of the printing head 1 in accordance with the embodiment of the present invention form a generally-wing-like sectional configuration which is asymmetrical about a center (center axis X) along the ink flowing direction indicated by arrow A in FIG. 2(*a*). Each of FIG. 2(*b*) and FIG. 3(*b*) shows a state where a bubble 10 is generated by instantaneously applying thermal energy to the ink on the heater 6. FIG. 2(*c*) and FIG. 3(*c*) are schematic plan views each showing an ink flow in the channel 7 when the bubble generated as shown in FIG. 2(*b*) or FIG. 3(*b*) collapses. The fact that the ink flows caused in the channels 7 shown in FIGS. 2(C) and 3(*c*) are different from each other is important. That is, ink flowing from the common liquid chamber 8 into the channel 7 flows uniformly in the case shown in FIG. 3(*c*), while ink flowing from the common liquid chamber 8 into the channel 7 flows along the channel wall members 4 in the case shown in FIG. 2(*c*), so that, by the influence of the channel wall members 4 asymmetrical about the ink flow direction, the ink also flows asymmetrically. A pressure difference is therefore caused in the channel 7 shown in FIG. 2(*c*) between portions 11 and 12 of the adjacent pair of the channel wall members 4. That is, a pressure difference due to the non-uniformity of the ink flow is caused in a region around the bubble 10. FIGS. 2(*d*) and 3(*d*) are schematic plan views each showing the ink flow in the channel 7 immediately before the bubble 10 collapses. The heater 6 and a channel portion around the heater 6 are eroded mainly when the bubble 10 collapses. In the state shown in FIG. 3(*d*), ink flowing from the common liquid chamber 8 into the channel 7 flows uniformly and no pressure difference occurs in the channel 7 between the portions 11 and 12 of the channel wall members 4. Therefore, the bubble 10 exists generally on the center axis X of the channel 7 immediately before its collapse. That is, the erosion action is concentrated at this position. In the state shown in FIG. 2(*d*), a pressure difference occurs in the channel 7 between the portions 11 and 12 of the channel wall members 4, so that a force is caused perpendicularly to the ink flow direction. In the case of this embodiment, the bubble 10 exists at a point between the center axis X of the channel 7 and the channel wall portion 11 immediately before its collapse. However, the pressure difference between the portions 11 and 12 is not constant, because the flow in the channel 7 is not constant and because the bubble 10 is unstable. Therefore, the bubble 10 does not always exist at this position immediately before its collapse. Accordingly, the erosion action of cavitation collapse pressure is dispersively distributed without being concentrated.

A printing head having an ink ejection direction parallel to a heater surface has been described as an embodiment of the present invention. However, the same can be said with respect to printing heads having any ink ejection directions relative to the heater surface.

Experiments described below were made by using the above-described printing heads.

EXPERIMENTAL EXAMPLE 1

A heater life test of ten printing heads having the ink channel structure shown in FIG. 2 (hereinafter referred to as "type A structure") and other ten printing heads having the ink channel structure shown in FIG. 3 (hereinafter referred to as "type B structure") was made by ejecting ink through these heads in such a manner that the life of each heater was determined when the heater broke during cycles of application of electrical printing signals to the heater for ejecting ink.

Figure 4:
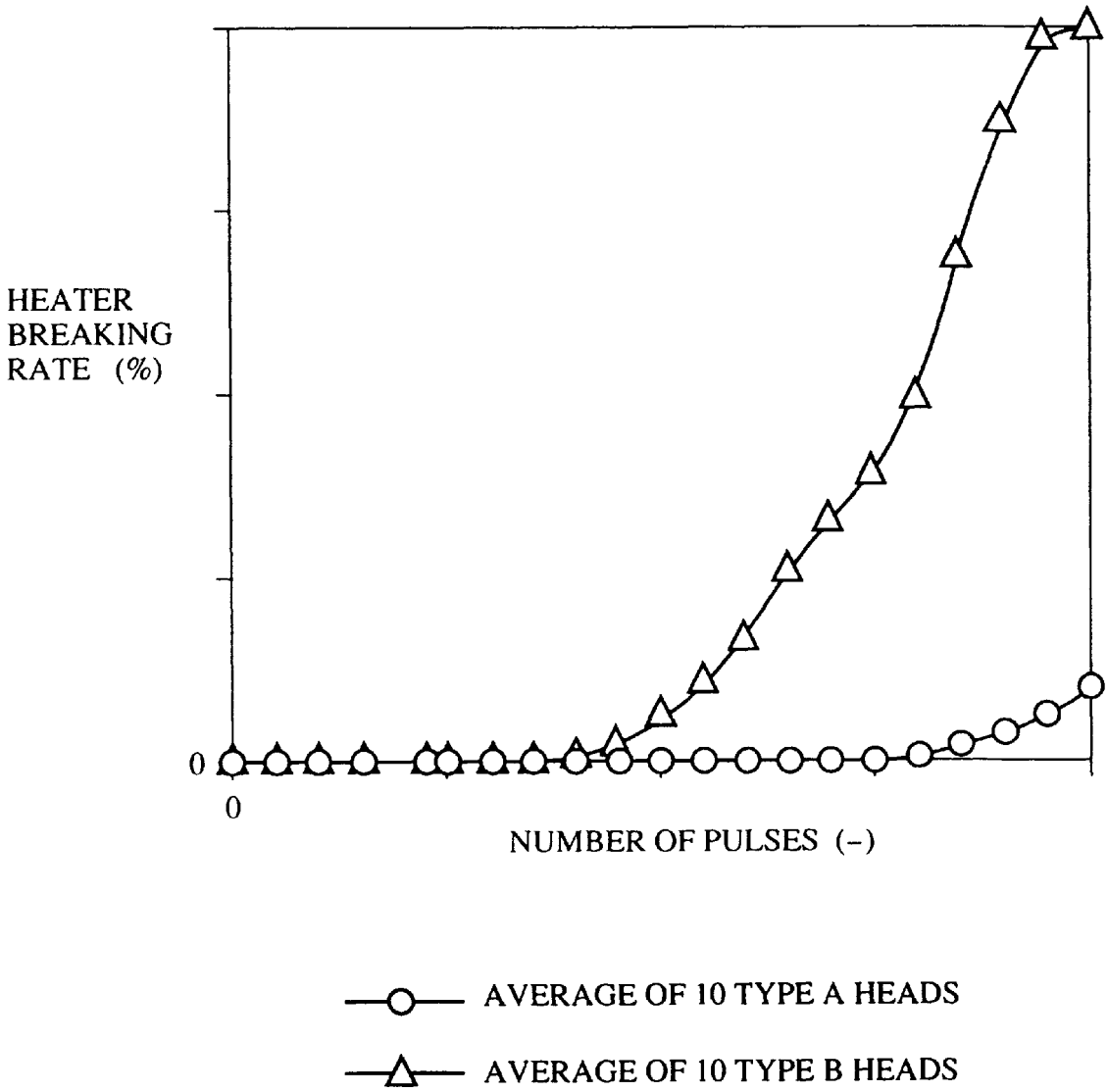
FIG. 4 is a graph showing the relationship between the number of times that image printing electrical signals are applied to heaters in the printing heads and the breaking rates of the heaters in the printing heads.

FIG. 4 is a graph of the breaking rate of the heaters in the printing heads of the type A and type B channel structures (the proportion of broken heaters to all the heaters in each head) with respect to the number of times of application of electrical printing signals to the heaters. Average values of ten heads of each type were plotted.

As is apparent from FIG. 4, the difference between the influences of the erosion actions of cavitation collapse pressure upon the heaters in the type A and type B channel structures is large. That is, the life of the heaters in the printing head having the type A channel structure is longer than that of the heaters in the printing head having the type B channel structure.

EXPERIMENTAL EXAMPLE 2

An ejection characteristic life test of ten printing heads having the type A channel structure and other ten printing heads having the type B channel structure was made by ejecting ink through these heads in such a manner that changes in the ink ejection velocity, the volume of ink droplets, and the direction of ejection with respect to the number of times of application of electrical printing signals to the heaters were measured and the life of each head was determined when the performance was substantially changed. This experiment was made by paying attention to the ink droplet ejection velocity relating to the quality of resulting printed images among the ejection characteristics.

Figure 5:
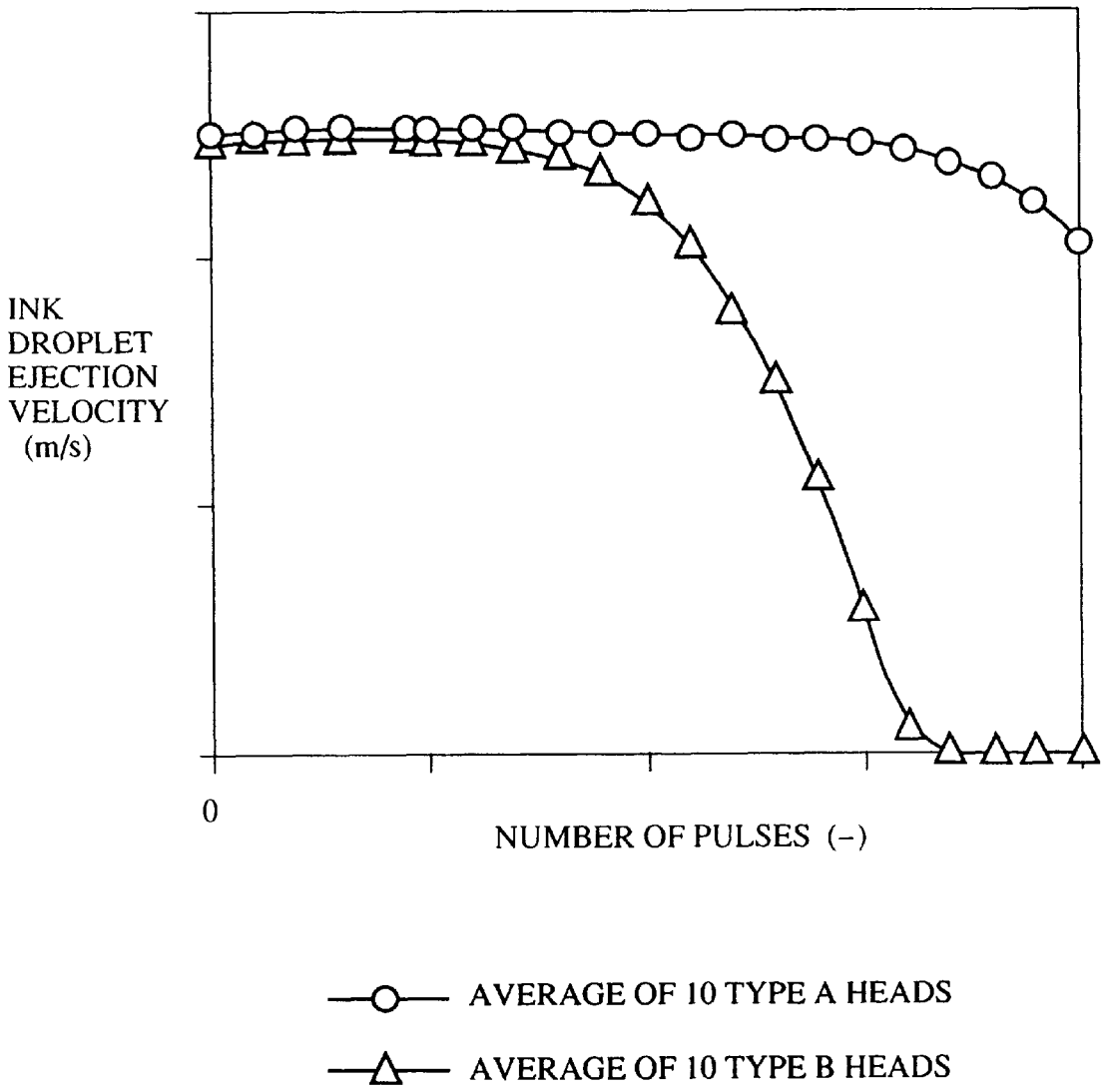
FIG. 5 is a graph showing the relationship between the number of times that electrical signals are applied to heaters in the printing heads and the velocity of ejected ink droplets.

FIG. 5 is a graph of the ink droplet ejection velocity with respect to the number of times of application of electrical printing signals to the heaters of the printing heads of the type A and type B channel structures. Average values of ten heads of each type were plotted.

As is apparent from FIG. 5, the difference between the influences of the erosion actions of cavitation collapse pressure upon the heaters in the type A and type B channel structures is large. That is, the life of the printing head having the type A channel structure with respect to the ejection characteristics is longer than that of the printing head having the type B channel structure.

EXPERIMENTAL EXAMPLE 3

The above-described ten printing heads having the type A channel structure and other ten printing heads having the type B channel structure (used in Experimental Example 2) were prepared and the states of deposits on the heater surfaces and channel portions around the heater surface of these heads were observed. The deposits observed were considered to be precipitates of ink components and impurities in ink.

It is presently believed that phenomena described below are mainly caused if such deposits attached to the heater surface and a portion around the heater surface are increased. First, attached deposits adversely influence the formation of a bubble in ink on the heater so that stability of bubble formation is reduced, resulting in a failure to obtain characteristics for stably ejecting ink droplets. Second, attached deposits and the material of the heater react chemically with each other to erode and break the heater. That is, for the printing head, it is preferred that no deposits are generated on the heater surface and a channel portion around the heater surface, or that the amount of deposits thereon is small.

FIGS. 6 and 7 are sketches showing the results of observation of heater portions in the printing heads 10 of the type A and type B channel structures after applying electric printing signals a number of times. FIG. 6 is a sketch of the heater surface in the type A channel structure, and FIG. 7 is a sketch of the heater surface in the type B channel structure. Although the state of only one heater in each structure is illustrated, the states of other heater surfaces are substantially the same. Dots in these sketches schematically represent deposits on the heaters.

As is apparent from FIGS. 6 and 7, there is a large difference between the states of attachment of deposits on the heater surfaces and portions around the heater surfaces in the type A and type B channel structures according to the difference between the influences of the erosion actions of cavitation collapse pressure. That is, it can be said that the area of attachment of deposits on the heater surface and the peripheral portion in the printing head having the type A channel structure is smaller than that in the printing head having the type B channel structure, because the erosion action of the cavitation collapse pressure upon the heater in the type A channel structure is distributed more dispersively than the erosion action in the type B channel structure. Therefore, the printing head having the type A channel structure can represent an example of the present invention realizing a liquid-jet printing head having a long life and capable of obtaining high-quality images with improved stability.

Figure 8:
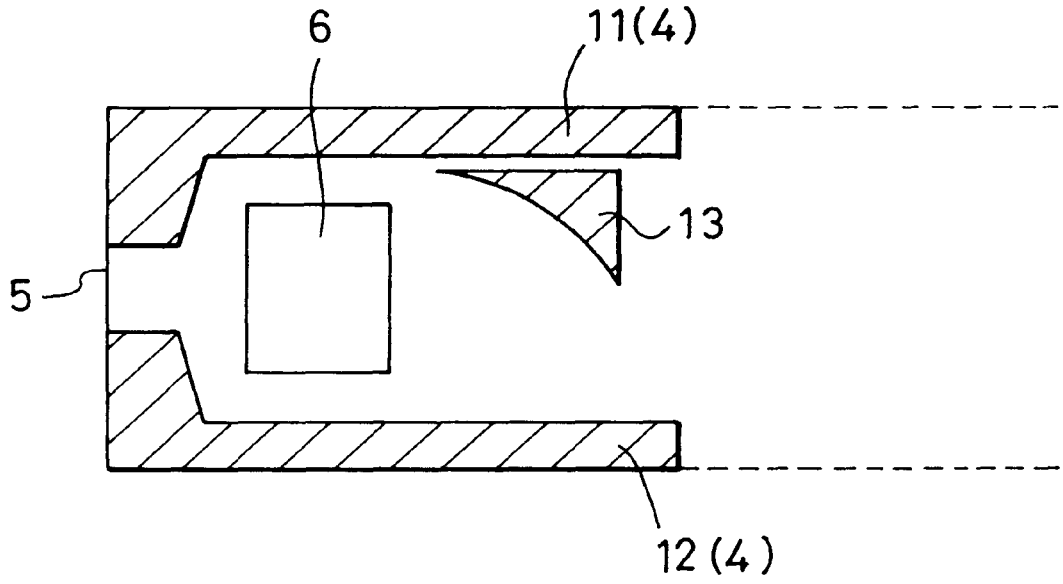
FIG. 8 is a plan view of the ink channel structure in a second embodiment of the printing head in accordance with the present invention.

A second embodiment of the present invention will be described with reference to FIG. 8. In this embodiment, a liquid flow changing member (hereinafter referred to as "ink flow changing member") 13 is provided independently of channel wall members 4 so that the channel structure has a wing-like sectional configuration similar to that in the first embodiment. The ink flow in each channel is thereby formed asymmetrically. This structure is advantageous in that an asymmetrical flow of ink in each channel about a bubble can be realized more effectively by using a small structural member, and that a larger pressure difference in a region around a bubble can therefore be controlled. It is therefore possible to provide a liquid-jet printing head having a long life through which improved ink ejection stability is maintained to obtain high-quality printed images.

Figure 9:
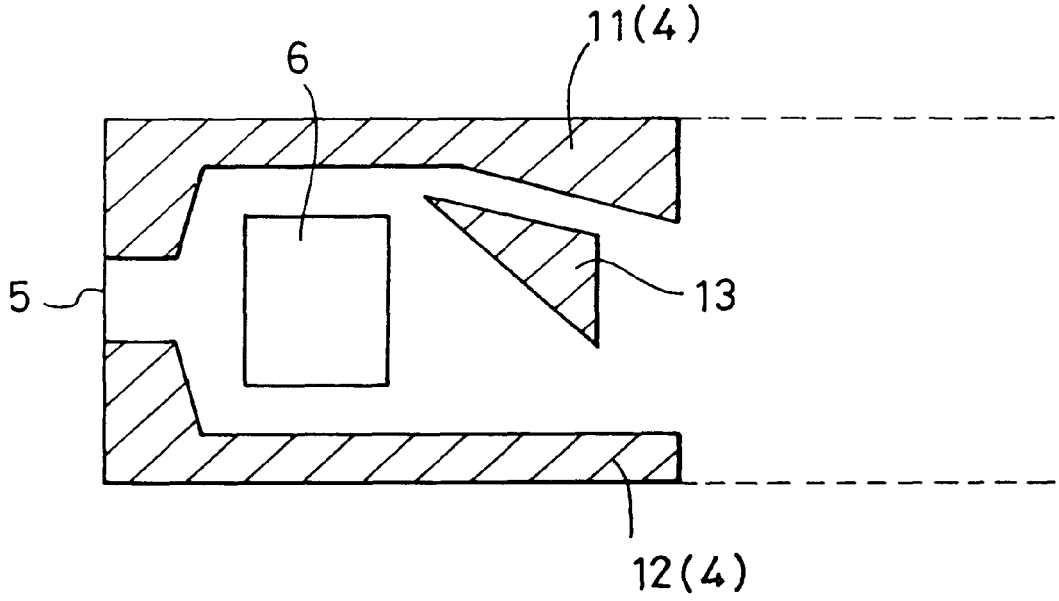
FIG. 9 is a plan view of the ink channel structure in a third embodiment of the printing head in accordance with the present invention.

A third embodiment of the present invention will be described with reference to FIG. 9. In this embodiment, the effect of a wing-like sectional configuration is increased by using channel walls and an ink flow changing member 13 separate from the channel walls so that a further asymmetry is created in an asymmetric ink flow formed in each channel. This structure is advantageous in that the pressure difference caused by an ink flow formed asymmetrically in each channel can be further increased by further changing the flow. It is therefore possible to provide a liquid-jet printing head having a long life through which improved ink ejection stability is maintained to obtain high-quality printed images.

A fourth embodiment of the present invention will be described with reference to FIGS. 10 and 11.

Figure 10:
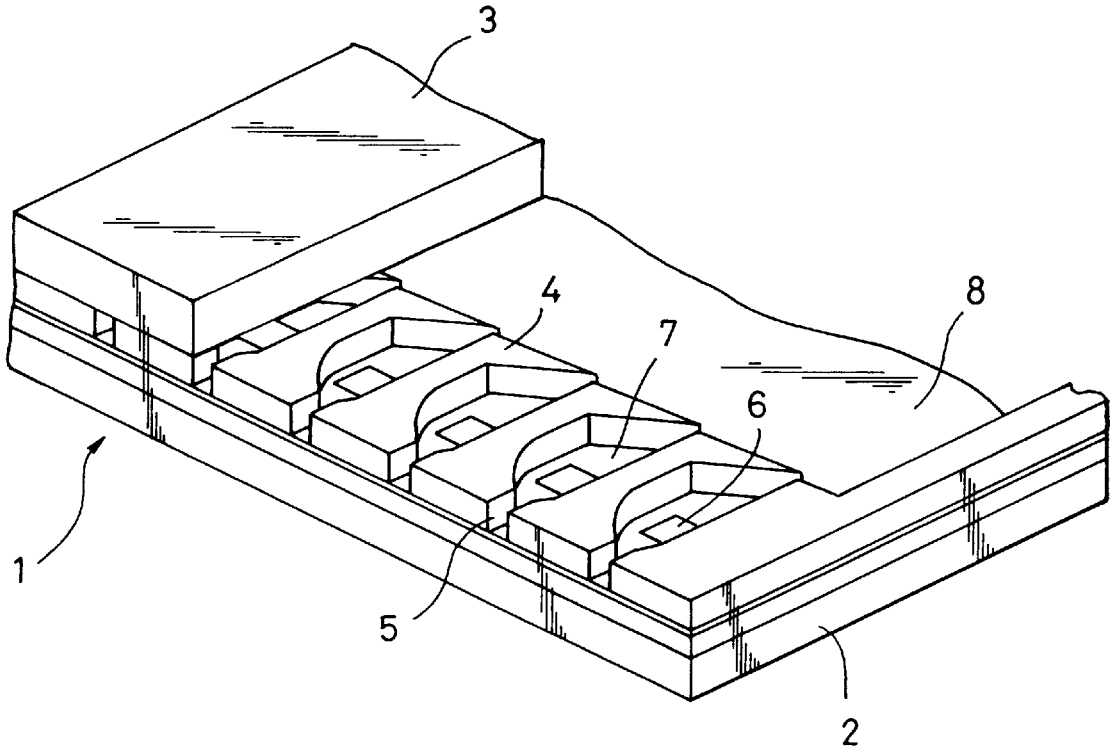
FIG. 10 is a perspective view of a fourth embodiment of the printing head in accordance with the present invention.
Figure 11A:
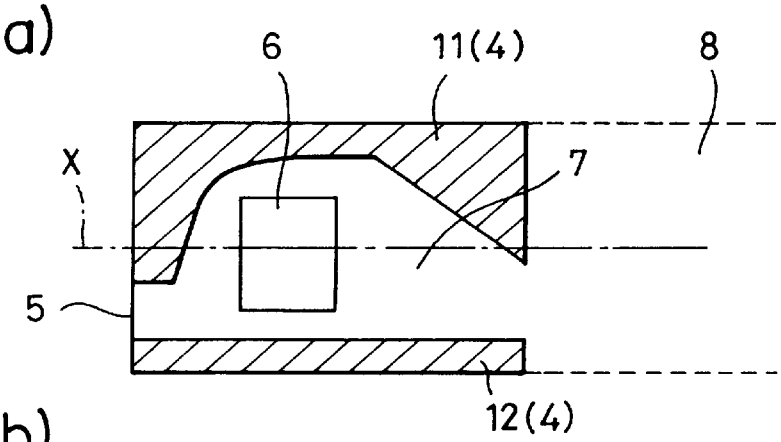
FIGS. 11(*a*) through 11(*d*) are plan views of the ink channel structure of the printing head shown in FIG. 10, showing the ink ejection mechanism.
Figure 11B:
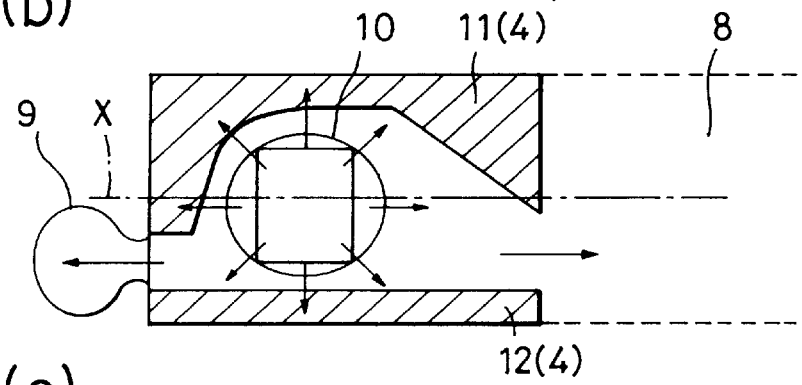
Figure 11C:
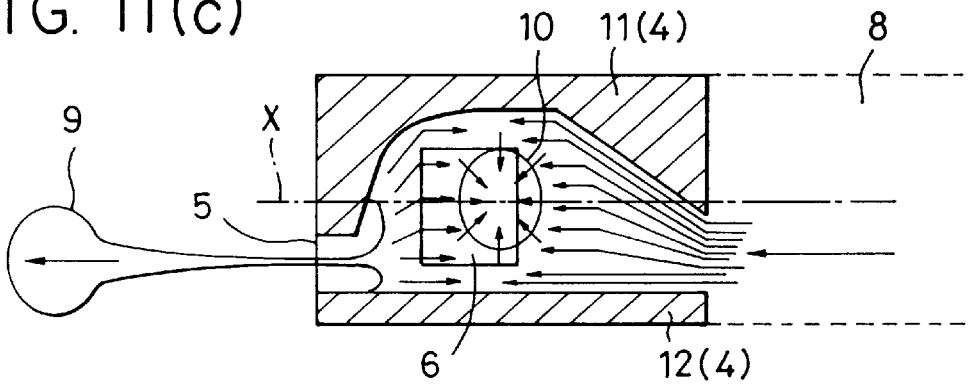
Figure 11D:
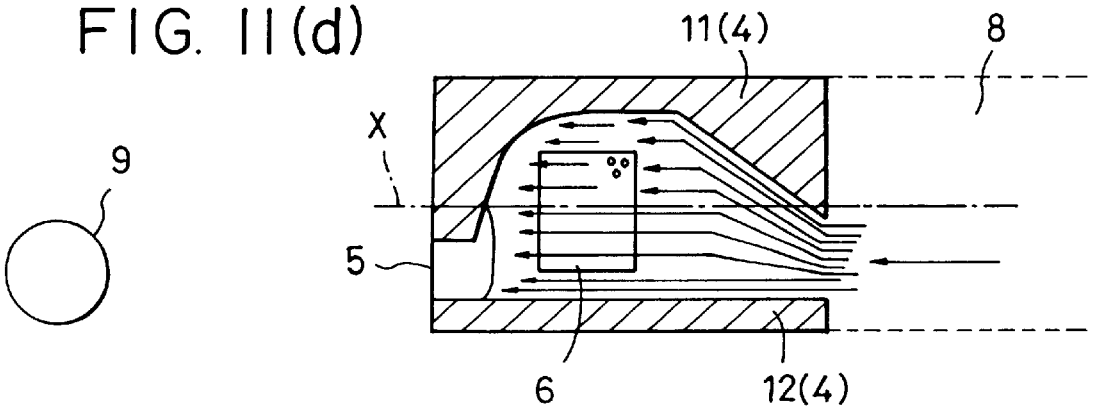

FIG. 10 is a perspective view of a fourth embodiment of the printing head in accordance with the present invention, and FIG. 11 is a plan view for explaining the ink ejection mechanism of the printing head shown in FIG. 10.

The difference between the embodiments shown in FIGS. 1 and 10 resides in the configuration of portions 11 of channel wall members 4 forming channels 7 having a wing-like sectional configuration. That is, each of the portions 11 and 12 in the arrangement shown in FIG. 1 is formed in the vicinity of the heater 6 so as to partially surround the heater 6 as in the case of the portion 12. In contrast, in the arrangement shown in FIG. 10, the portion 12 of one of each adjacent pair of wall members is formed in the vicinity of the heater 6 so as to have a straight flat surface, while the portion 11 is formed so as to partially surround the heater 6.

If one of the two wall portions forming one channel is formed so as to have a flat inner surface and so that the supply portion and the nozzle are aligned with each other, the degree of asymmetry of the ink flow in the channel is maximized. Therefore, this arrangement has a further improved effect in comparison with the arrangement shown in FIG. 1.

Printing is performed by using the thus-constructed head 1 as described below. First, the channels 7 are filled with ink from the common liquid chamber 8 (see FIG. 11(*a*)). Next, electrical printing signals are applied to some of the heaters 6 through the electric wiring 6. The heaters 6 are thereby heated and thermal energy is applied from the heaters 6 to the ink existing in the channels 7 in the vicinity of the heaters 6. By this application of thermal energy applied from the heaters 6 to the ink, a bubble is generated with an instantaneous increase in volume in the ink receiving the thermal energy in the channel 7 (see FIG. 11(*b*)). A part of the ink existing on the downstream side of each heater 6 (nozzle 5 side) is ejected through the outlet 5 to form a flying ink droplet 9 (see FIG. 11(*c*)). The ink droplets 9 is attached to an ink supporting member such as paper (not shown) which has been fed to a position in front of the printing head 1, thereby printing a desired image (see FIG. 11(*d*)).

The difference between this embodiment and the conventional printing head will be described with reference to FIGS. 11(*a*) to 11(*d*) and FIGS. 3(*a*) to 3(*d*).

FIG. 11(*a*) and FIG. 3(*a*) are schematic plan views of the printing heads showing states where liquid channels are filled with ink. As is apparent from these figures, the channel wall members 4 of the printing head 1 in accordance with this embodiment form a generally-wing-like sectional configuration by partially surrounding the heater 6. FIG. 11 (*b*), corresponding to FIG. 3(*b*), shows a state where a bubble 10 is generated by instantaneously applying thermal energy to the ink on the heater 6. FIG. 11(*c*), corresponding to FIG. 3(*c*), is a schematic plan view showing an ink flow in the channel 7 when the bubble generated as shown in FIGS. 11(*b*) collapses. It can be understood that the ink flows caused in the channels 7 shown in FIGS. 11(C) and 3(*c*) are different from each other. That is, ink flowing from the common liquid chamber 8 into the channel 7 flows uniformly in the case shown in FIG. 3(*c*), while in the case shown in FIG. 11(*c*) ink flowing from the common liquid chamber 8 into the channel 7 flows along the channel wall members 4 forming the wing-like space in the channel 7 so that the ink flow on the periphery of the bubble 10 is asymmetrical about the X axis. By this asymmetric flow, a pressure difference is caused in a region around the bubble 10. FIGS. 11(*d*) and 3(*d*) are schematic plan views each showing the ink flow in the channel 7 immediately before the bubble 10 generated as shown in FIG. 11(*b*) or 3(*d*) collapses. The heater 6 and a channel portion around the heater 6 are eroded by cavitation collapse pressure mainly when the bubble 10 collapses. In the state shown in FIG. 3(*d*), ink flows uniformly in the channel 7 and, therefore, no pressure difference occurs about the bubble 10. Therefore, the bubble 10 exists generally on the center axis X of the channel 7 immediately before its collapse. That is, the erosion action is concentrated at this position. In the state shown in FIG. 11(*d*), a pressure difference occurs in the channel 7 in a region around the bubble 10, and a force is thereby caused perpendicularly to the ink flow direction. In the case of this embodiment, therefore, the bubble 10 exists on a point between the center axis X of the channel 7 and the channel wall portion 11 immediately before its collapse. However, the pressure difference in the region around the bubble 10 is not constant, because the flow in the channel 7 is not always stable. Therefore, the bubble 10 does not always exist at this position immediately before its collapse. Accordingly, the resulting erosion action is not concentrated.

A printing head having an ink ejection direction parallel to a heater surface has been described as a second embodiment as well as the first embodiment. However, the same can be said with respect to printing heads having any ink ejection directions relative to the heater surface.

Experiments described below were made by using the above-described printing heads.

EXPERIMENTAL EXAMPLE 4

A heater life test of printing heads having the type C ink channel structure shown in FIG. 11 and ten other printing heads having the type B ink channel structure shown in FIG. 3 was made by ejecting ink through these heads in the same manner as Experimental Example 1.

Figure 12:
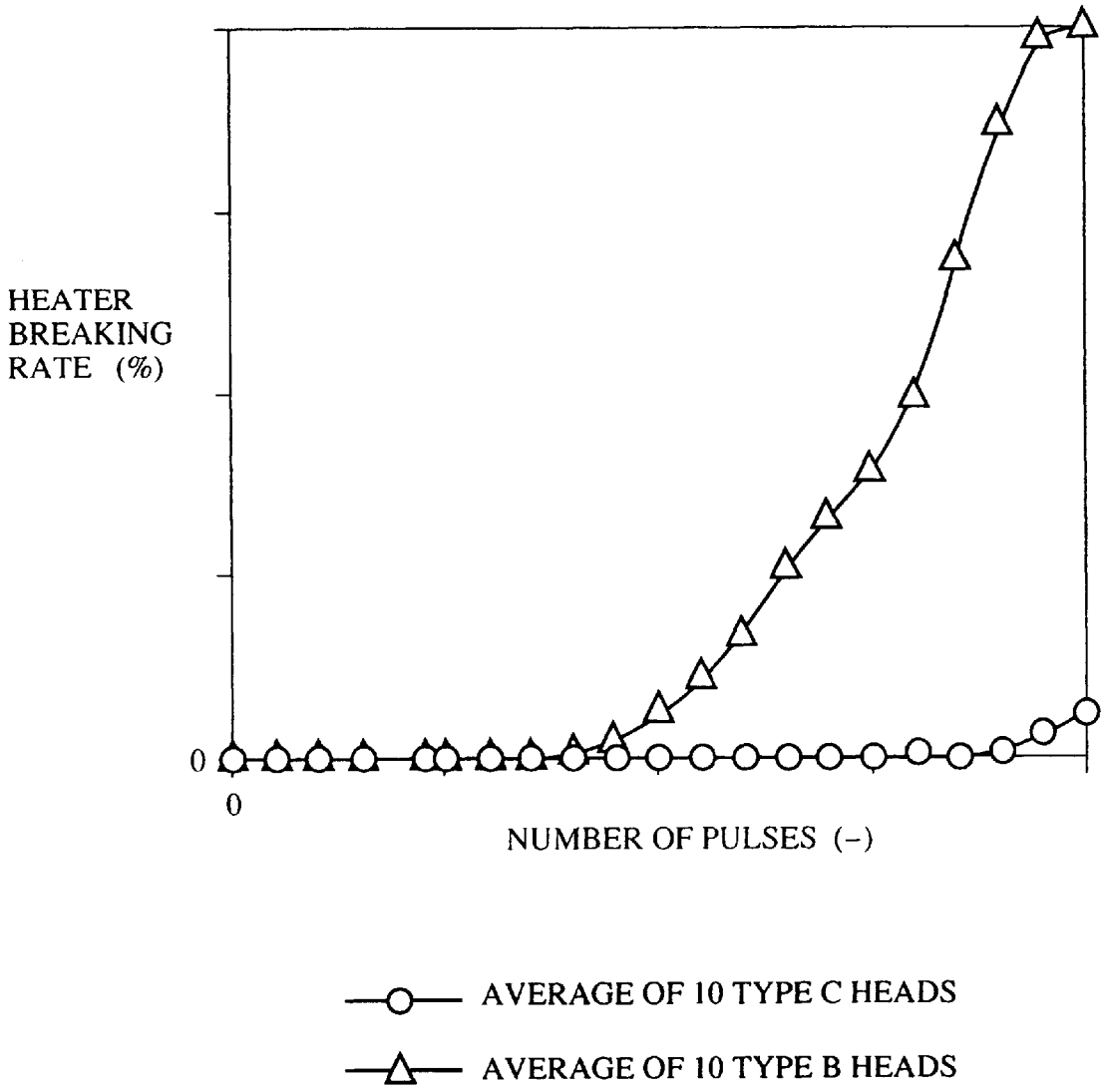
FIG. 12 is a graph showing the relationship between the number of times that image printing electrical signals are applied to the heaters in the printing heads and the breaking rates of the heaters in the printing heads.

FIG. 12 is a graph of the breaking rate of the heaters in the printing heads of the type C and type B channel structures with respect to the number of times of application of electrical image printing signals to the heaters. Average values of ten heads of each type were plotted.

As is apparent from FIG. 12, the difference between the influences of the erosion actions of cavitation collapse pressure upon the heaters in the type C and type B channel structures is large. That is, the life of the heaters in the printing head having the type C channel structure is longer than that of the heaters in the printing head having the type B channel structure.

EXPERIMENTAL EXAMPLE 5

An ejection characteristic life test was made by ejecting ink through ten printing heads having the type C channel structure shown in FIG. 11 and ten other printing heads having the type B channel structure shown in FIG. 3 in the same manner as Experimental Example 2.

Figure 13:
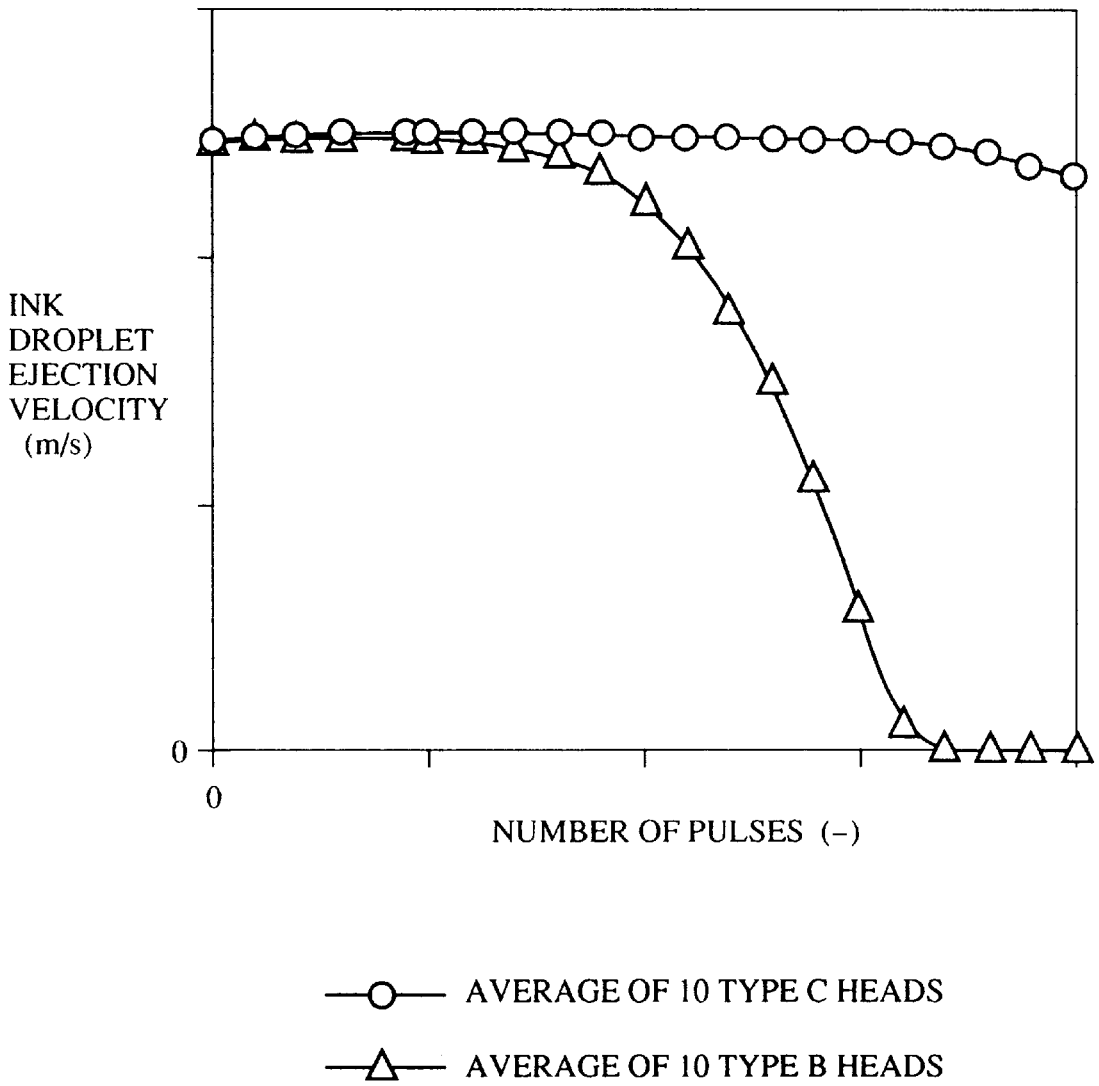
FIG. 13 is a graph showing the relationship between the number of times that electrical signals are applied to heaters in the printing heads and the velocity of ejected ink droplets.

FIG. 13 is a graph of the ink droplet ejection velocity with respect to the number of times of application of electrical printing signals to the heaters of the printing heads of the type C and type B channel structures. Average values of ten heads of each type were plotted.

As is apparent from FIG. 13, the life of the printing head having the type C channel structure with respect to the ejection characteristics (ejection velocity) is noticeably longer than that of the printing head having the type B channel structure. From this result, it can be understood that the difference between the influences of the erosion actions upon the heaters in the type C and type B channel structures is large.

EXPERIMENTAL EXAMPLE 6

The states of deposits on the heater surfaces and channel portions around the heater surface of the above-described ten printing heads having the type C channel structure and ten other printing heads having the type B channel structure (used in Experimental Example 5) were observed, as in the case of Experimental Example 3.

Figure 14:
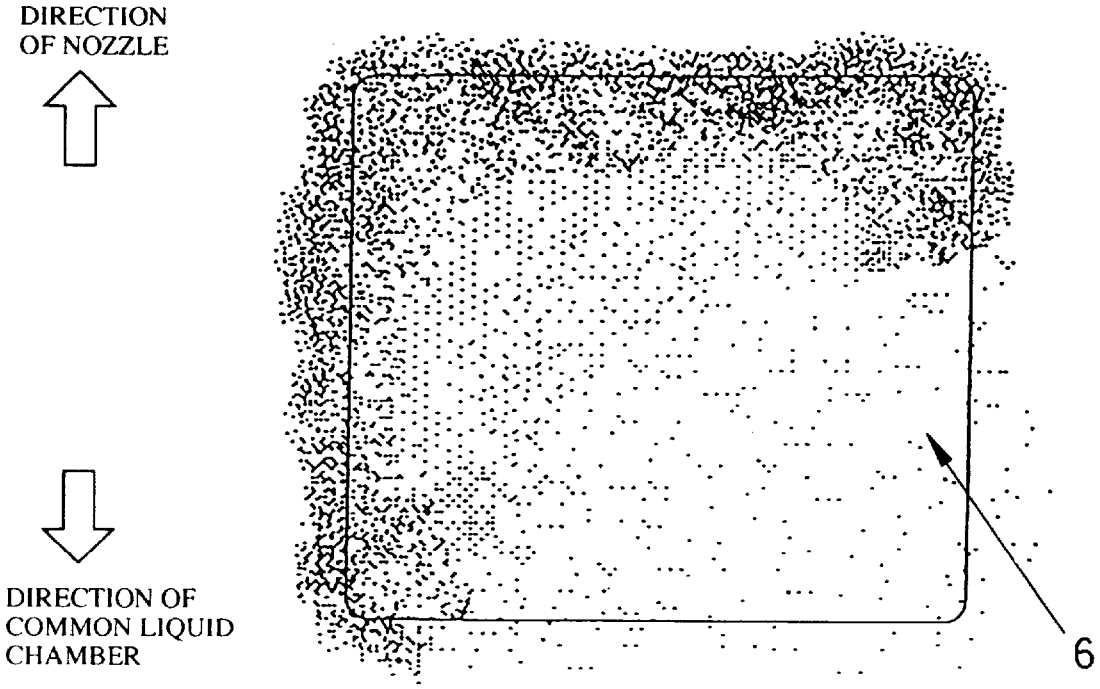
FIG. 14 is a sketch drawn by observing the influence of the erosion action of cavitation collapse upon a heater portion of the printing head shown in FIG. 10.
Figure 15:
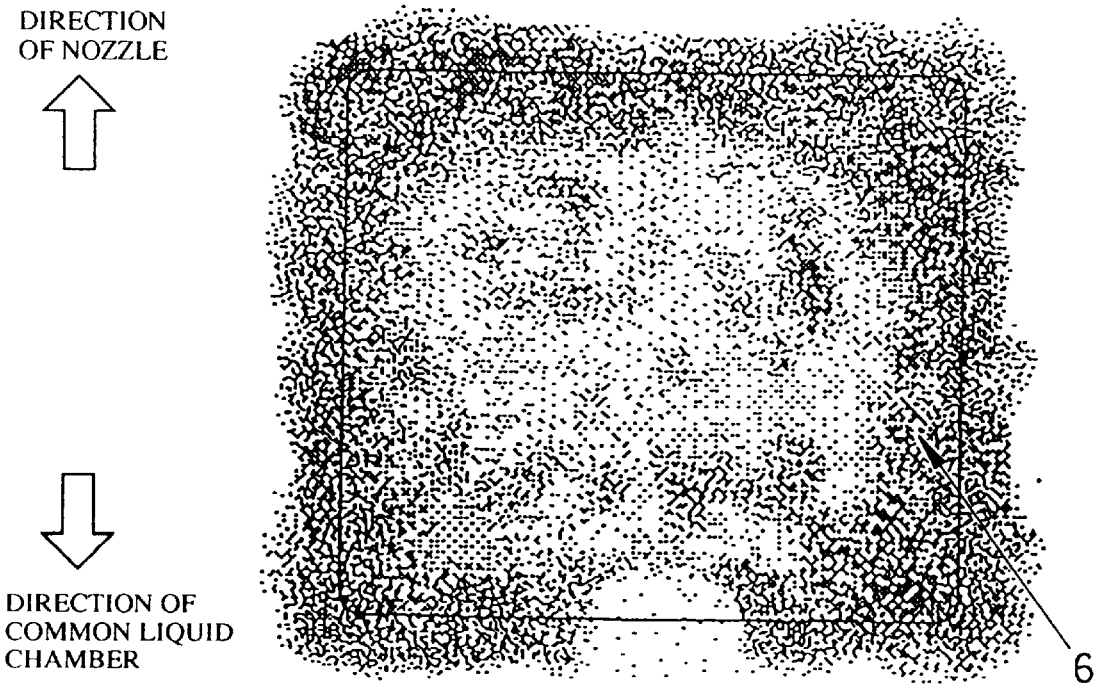
FIG. 15 is a sketch drawn by observing a heater portion of the conventional printing head.

FIGS. 14 and 15 are sketches showing the results of observation of heater portions in the printing heads 10 of the type C and type B channel structures. FIG. 14 is a sketch of the heater surface in the type C channel structure, and FIG. 15 is a sketch of the heater surface in the type B channel structure. In each sketch, a top side corresponds to the outlet 5 side of the printing head, while a bottom side corresponds to the common liquid chamber 8 side. Although the state of only one heater in each of the type C and type B structures is illustrated, the states of other heater surfaces are substantially the same.

As is apparent from FIGS. 14 and 15, there is a large difference between the states of attachment of deposits on the heater surfaces and portions around the heater surfaces in the type C and type B channel structures according to the difference between the influences of the erosion actions of cavitation collapse pressure. It can be said that the area where erosion occurs in the printing head having the type C channel structure is larger than that in the printing head having the type B channel structure, and that, accordingly, the area of attachment of deposits and the amount of deposits on the heater surface and the portion around the heater in the type C structure are smaller. Therefore, the printing head having the type C channel structure can represent an example of the present invention realizing a liquid-jet printing head having a long life through which improved ink ejection stability is maintained to obtain high-quality printed images.

Figure 16:
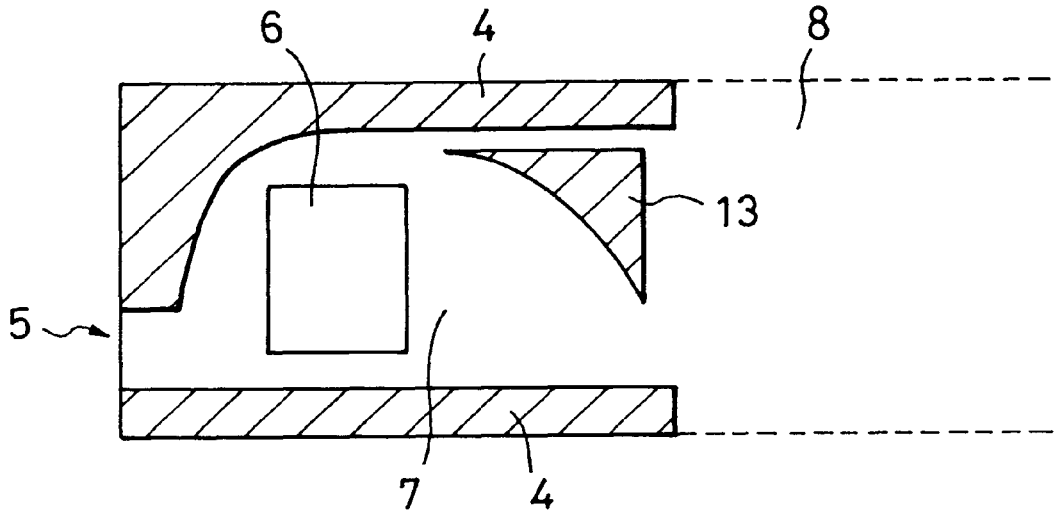
FIG. 16 is a perspective view of the ink channel structure in a fifth embodiment of the printing head in accordance with the present invention.

FIG. 16 shows a fifth embodiment of the present invention. In this embodiment, a liquid flow changing member 13 is provided independently of channel wall members 4 so that each of channels 7 has a wing-like sectional configuration. The ink flow in each channel 7 from the common liquid chamber 8 to the heater 6 is thereby formed asymmetrically. This structure is advantageous in that an asymmetrical flow of ink in each channel about a bubble can be realized more effectively by using a small structural member, and that a larger pressure difference in a region around a bubble can therefore be controlled. It is therefore possible to provide a liquid-jet printing head having a long life through which improved ink ejection stability is maintained to obtain high-quality printed images.

Figure 17:
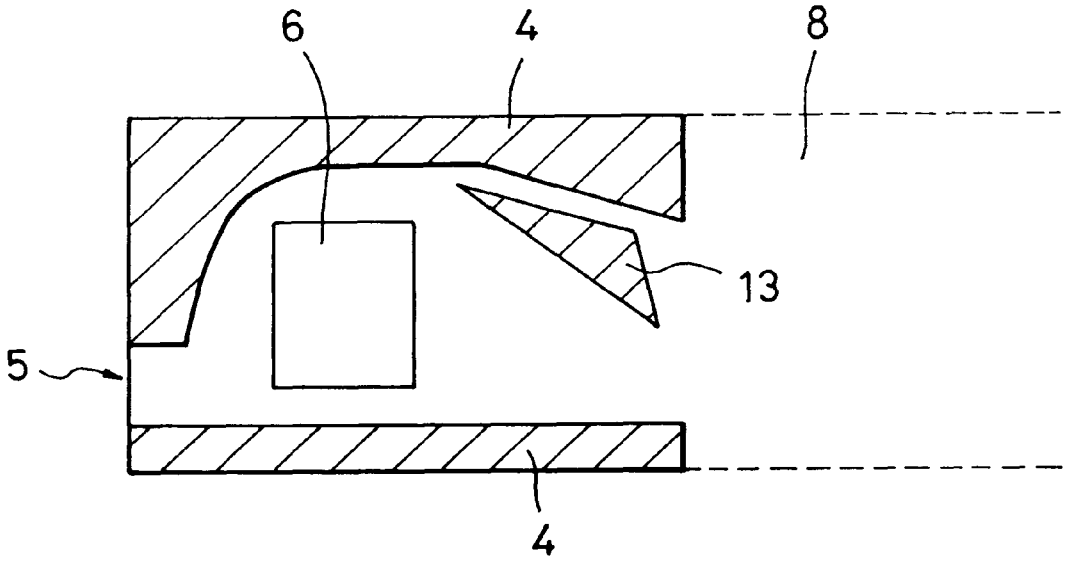
FIG. 17 is a perspective view of the ink channel structure in a sixth embodiment of the printing head in accordance with the present invention.

FIG. 17 shows a sixth embodiment of the present invention. In this embodiment, a combination of channel wall members 4 and an ink flow changing member 13 separate from the channel wall members is used to form a wing-like sectional configuration such that a further asymmetry is created in an asymmetric ink flow formed in each of channels 7. This structure is advantageous in that the pressure difference caused in a region around a bubble 10 by an ink flow formed asymmetrically in each channel 7 can be further increased by changing the ink flow. It is therefore possible to provide a liquid-jet printing head having a long life through which improved ink ejection stability is maintained to obtain high-quality printed images.

Figure 18:
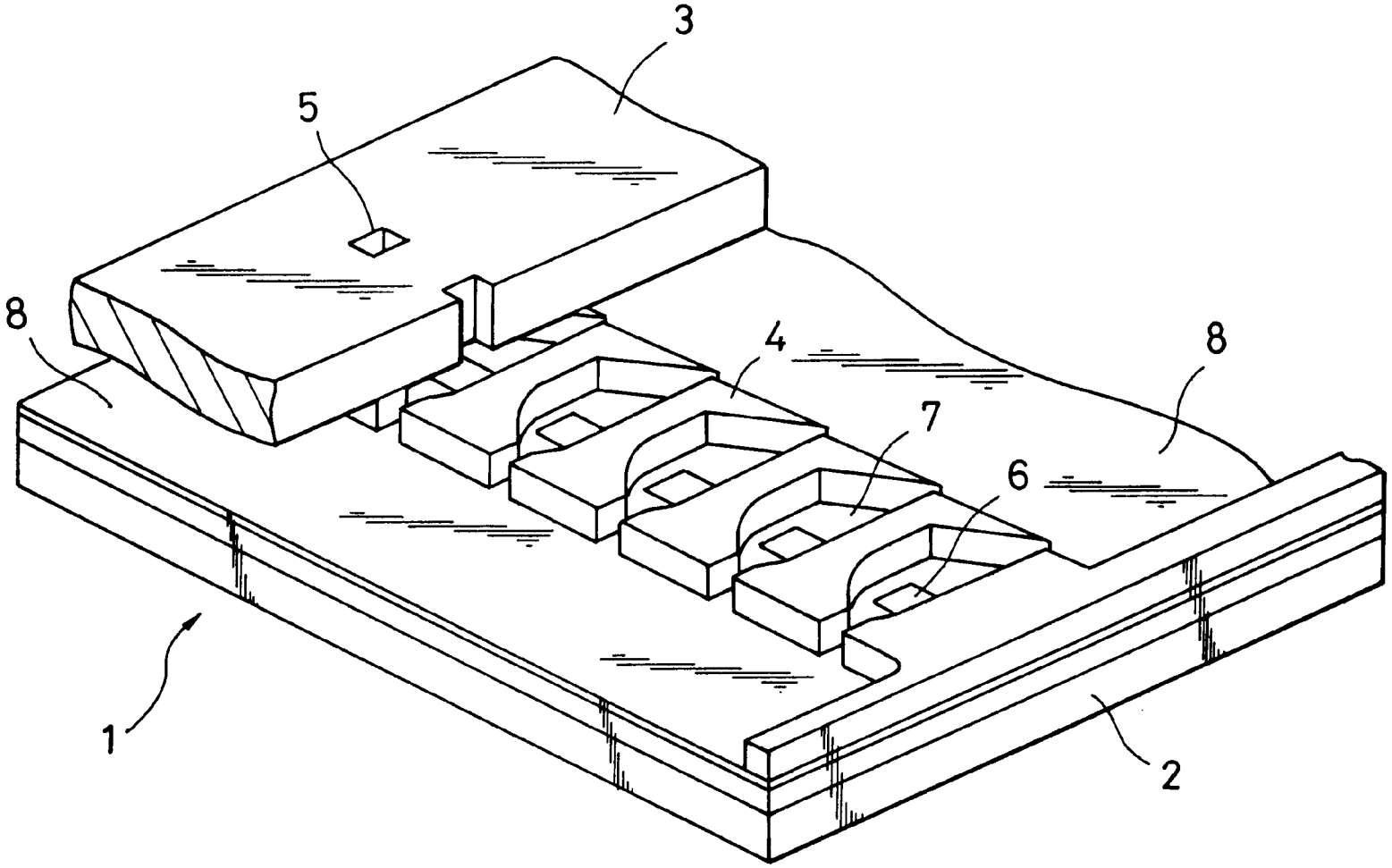
FIG. 18 is a perspective view of the ink channel structure in a seventh embodiment of the printing head in accordance with the present invention.

FIG. 18 shows a seventh embodiment of the present invention. In this embodiment, an example of a printing head structure is adopted which comprises the channel structure C shown in FIG. 11, and in which the surface of each heater 6 and the opening surface of the corresponding outlet 5 are disposed parallel to each other.

Figure 19:
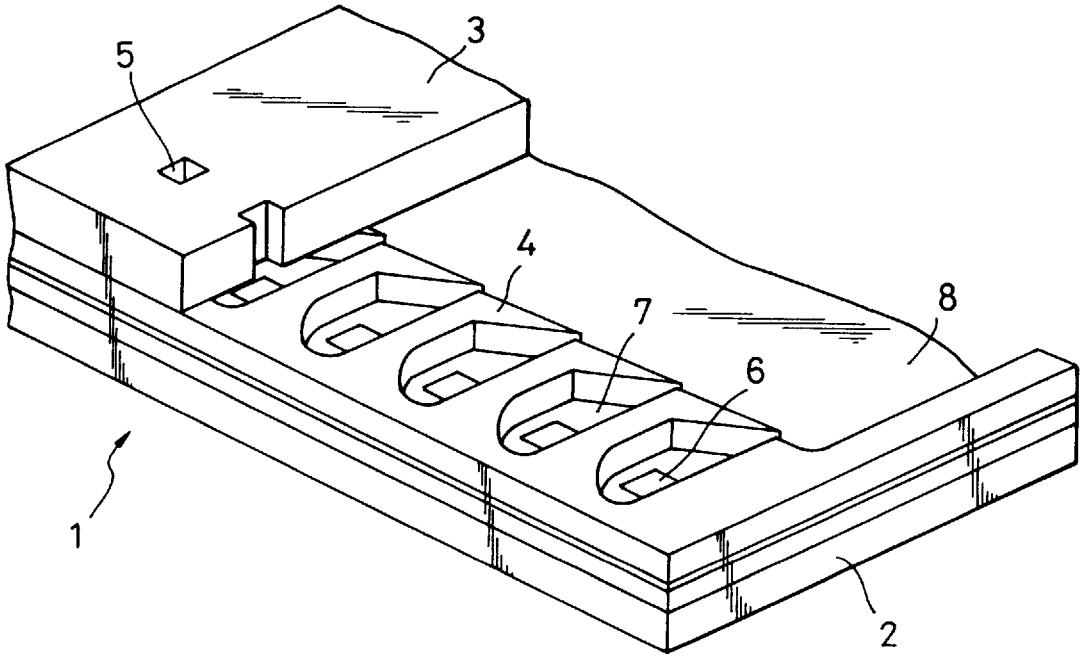
FIG. 19 is a perspective view of the ink channel structure in an eighth embodiment of the printing head in accordance with the present invention.

FIG. 19 shows an eighth embodiment of the present invention. In this embodiment, an example of a printing head structure is adopted in which a wing-like space is formed around each heater 6 by channel wall members 4, and in which the surface of the heater 6 and the opening surface of the corresponding outlet 5 are disposed parallel to each other.

The arrangement of each of the printing heads shown in FIGS. 18 and 19 has the same effect as that of the first embodiment printing head, making it possible to provide a liquid-jet printing head having a long life through which improved ejection stability can be maintained to obtain high-quality printed images.

A ninth embodiment of the printing head in accordance with the present invention will be described with reference to FIGS. 20 and 21.

Figure 20:
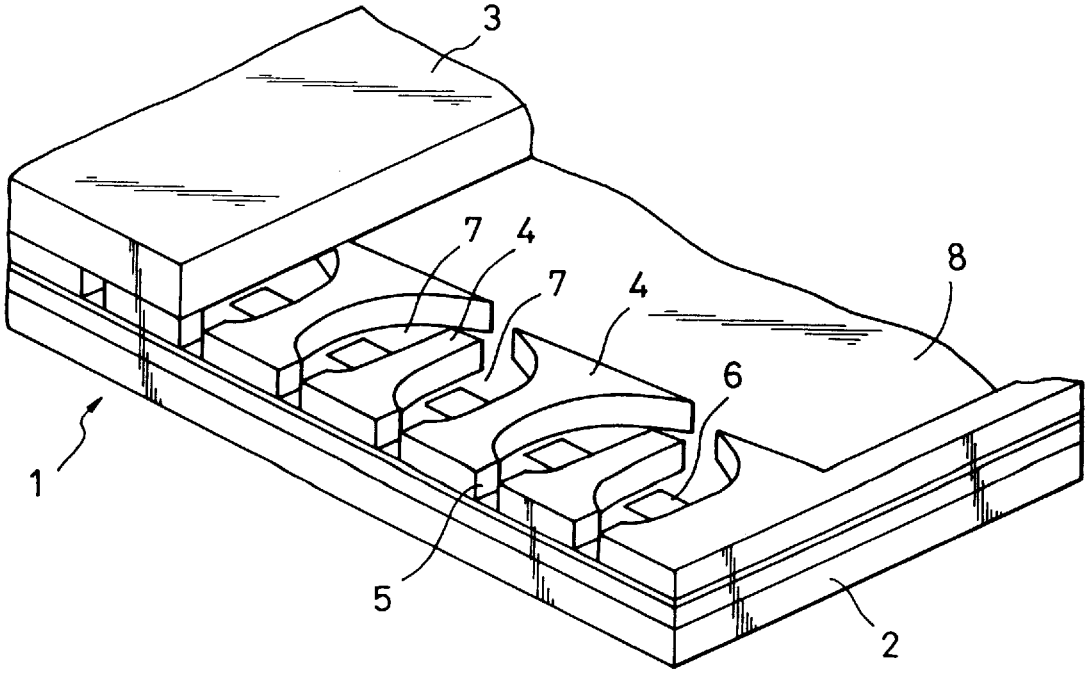
FIG. 20 is a perspective view of a ninth embodiment of the printing head in accordance with the present invention.
Figure 21:
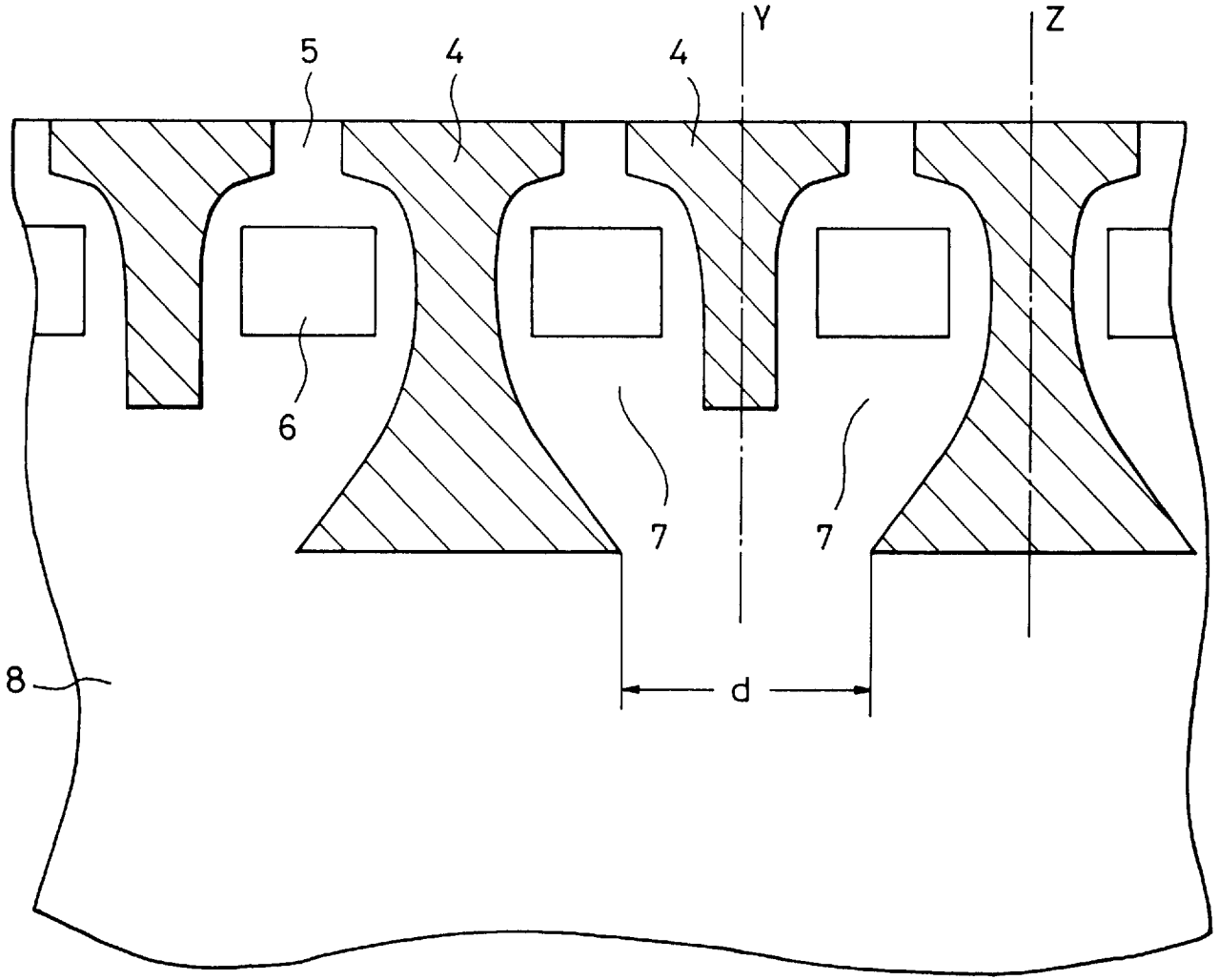
FIG. 21 is a plan view of the ink channel structure of the printing head shown in FIG. 20.

FIG. 20 is a perspective view of the ninth embodiment of the present invention, and FIG. 21 is a plan view of the printing head 1 shown in FIG. 20. In this embodiment, as is apparent from these figures, channel wall members 4 partially surround heaters 6 so as to form wing-like spaces in channels 7 of the printing head 1, and each adjacent pair of channels 7 is symmetrical about a channel wall 4Y provided therebetween or about a cross section along a line Z. Also, the two channels about each channel wall 4Y form an associated pair. Each channel wall member 4 has a configuration different from that of the adjacent channel wall members 4. The wall member between each associated pair of channels is shorter than the adjacent wall members in length in the direction of depth of the printing head, so that the opening width (d) on the common liquid chamber side can be large, thereby improving refilling performance.

Figure 22:
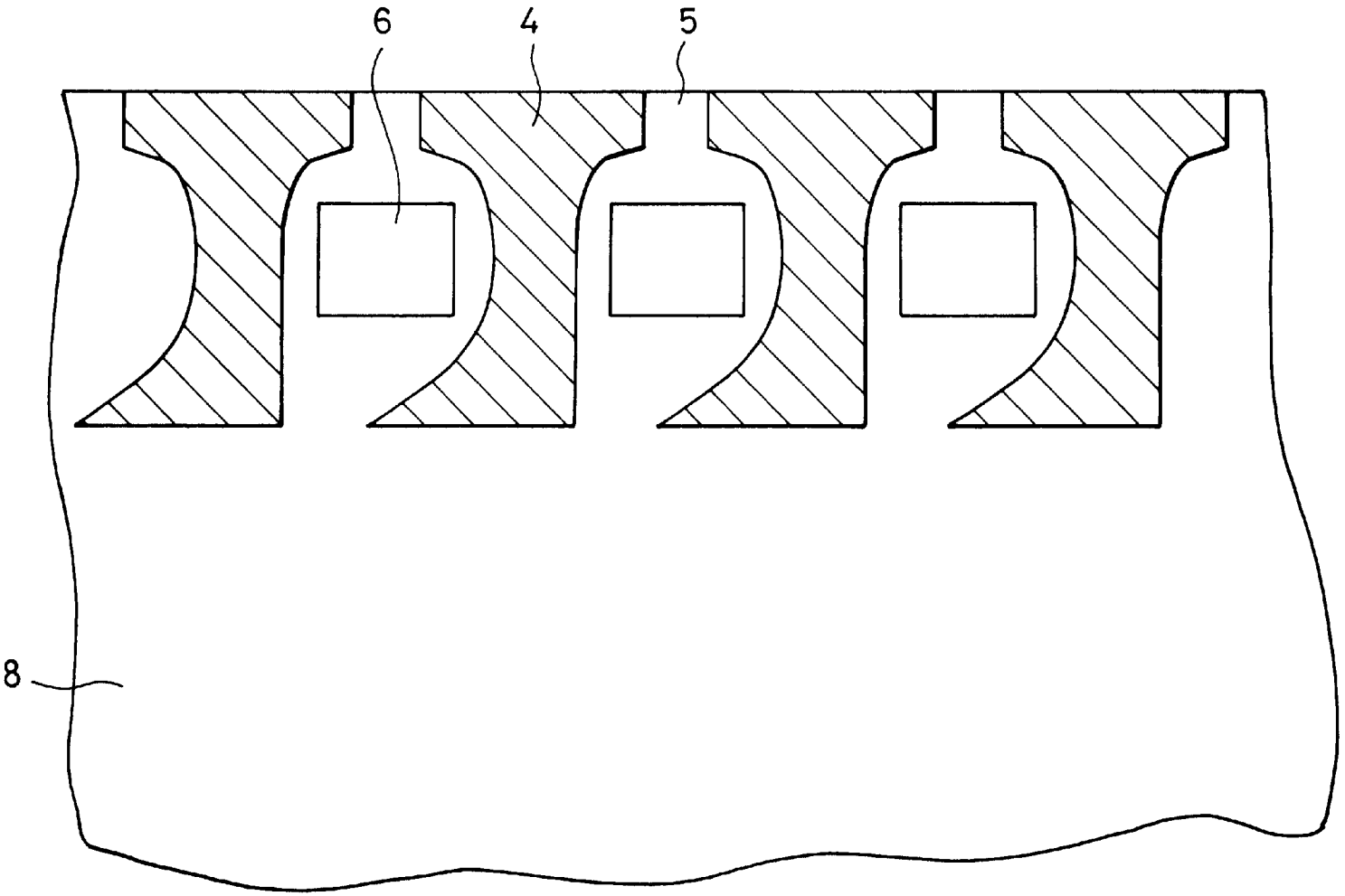
FIG. 22 is a plan view of the ink channel structure of a printing head in accordance with a related art.

FIG. 22 is a plan view of a conventional printing head achieving high-speed printing based on an art relating to the present invention. As is apparent from FIG. 22, the distance between each heater 6 and the common liquid chamber 8 is reduced to achieve high-speed printing.

Experiments described below were made with respect to the above-described printing heads, i.e., the printing head having the structure shown in FIG. 21, hereinafter referred to as "type D printing head", and the printing head having the structure shown in FIG. 22, hereinafter referred to as "type E printing head". These printing heads are constructed so that their thermal energy transducing elements are equal in size, and that ink droplets ejected from these heads are substantially equal in volume and velocity.

EXPERIMENTAL EXAMPLE 7

For realization of stable high-speed printing, it is desirable that no crosstalk occurs when the printing head is driven. Situations where crosstalk occurred were observed in the experiment shown below.

The type D printing head and the type E printing head were driven at the same driving frequency for high-speed driving to eject ink. The amount of recession of a meniscus in each of nozzles 5 in association with adjacent four channels 7 in each printing head (the amount of movement of the interface between external air and the ink surface) "atmosphere" was measured by successively energizing the heaters 6 in the four adjacent channels under the above-mentioned driving condition.

Figure 23:
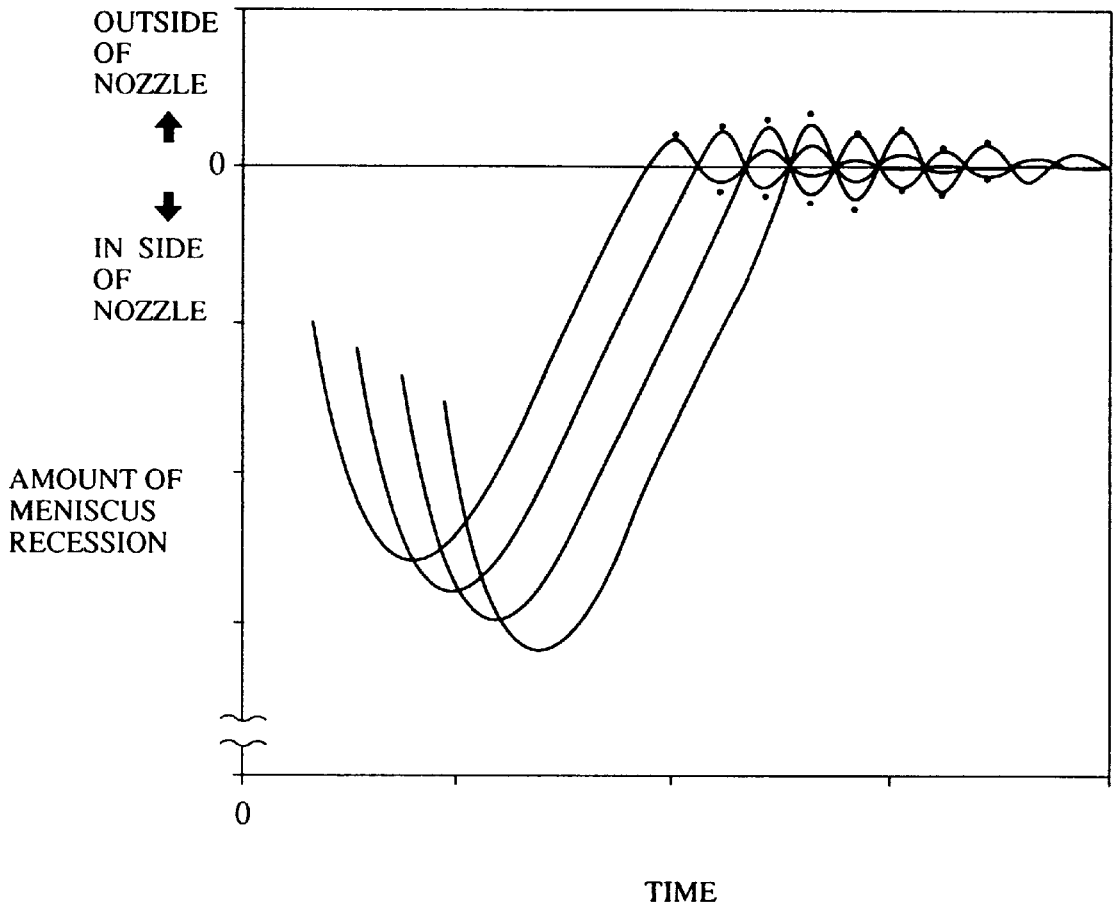
FIG. 23 is a graph showing the relationship between the amount of meniscus recession and time when the printing head of the related art is driven at a high frequency.

FIG. 23 is a graph showing the amount of recession of the meniscuses in the outlets 5 of the type E printing head with respect to time. It can be understood that the amounts of recession of the meniscuses are successively increased in the order of the times at which energization of the heaters 6 in the four adjacent channels is successively started. This is because the ink flow from the common ink chamber 8 in each channel in which the heater 6 is energized influences the flow in the adjacent channels.

Figure 24:
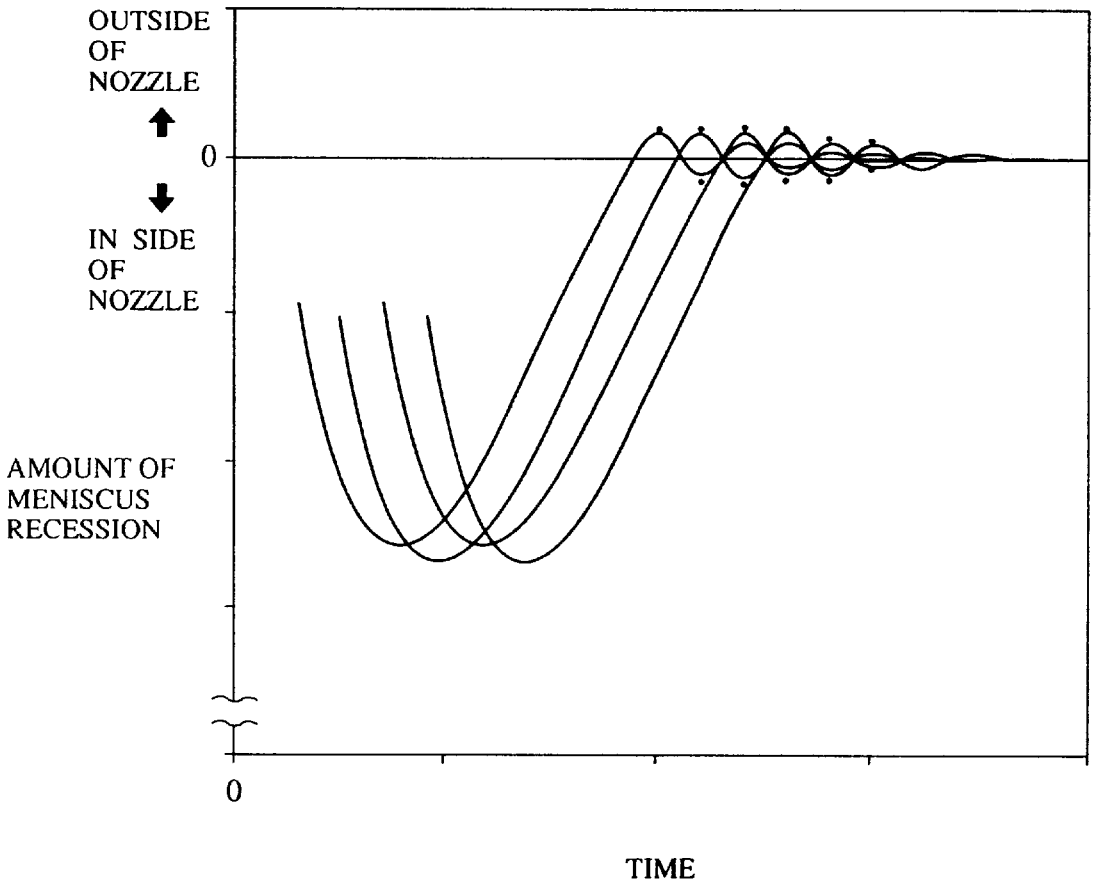
FIG. 24 is a graph showing the relationship between the amount of meniscus recession and time when the printing head of the present invention is driven at a high frequency.

FIG. 24 is a graph showing the amount of recession of the meniscuses in the outlets 5 of the type D printing head with respect to time. It can be understood that the amounts of recession of the meniscuses have small dispersions with respect to the times at which energization of the heaters 6 in the four adjacent channels is successively started.

From these results, it can be understood that the type D printing head having the channel structure in accordance with the present invention is capable of stable driving necessary for obtaining a high-quality printed image.

EXPERIMENTAL EXAMPLE 8

For realization of stable high-speed printing and maintenance of the performance for obtaining high-quality printed images, it is desirable that no crosstalk occurs when the printing head is driven. That is, it is desirable to limit variations in the volume of ejected ink due to "crosstalk". The type D printing head and the type E printing head were driven at the same driving frequency for high-speed driving to eject ink, and the volumes of ink ejected from the printing heads were measured and compared.

Figure 25:
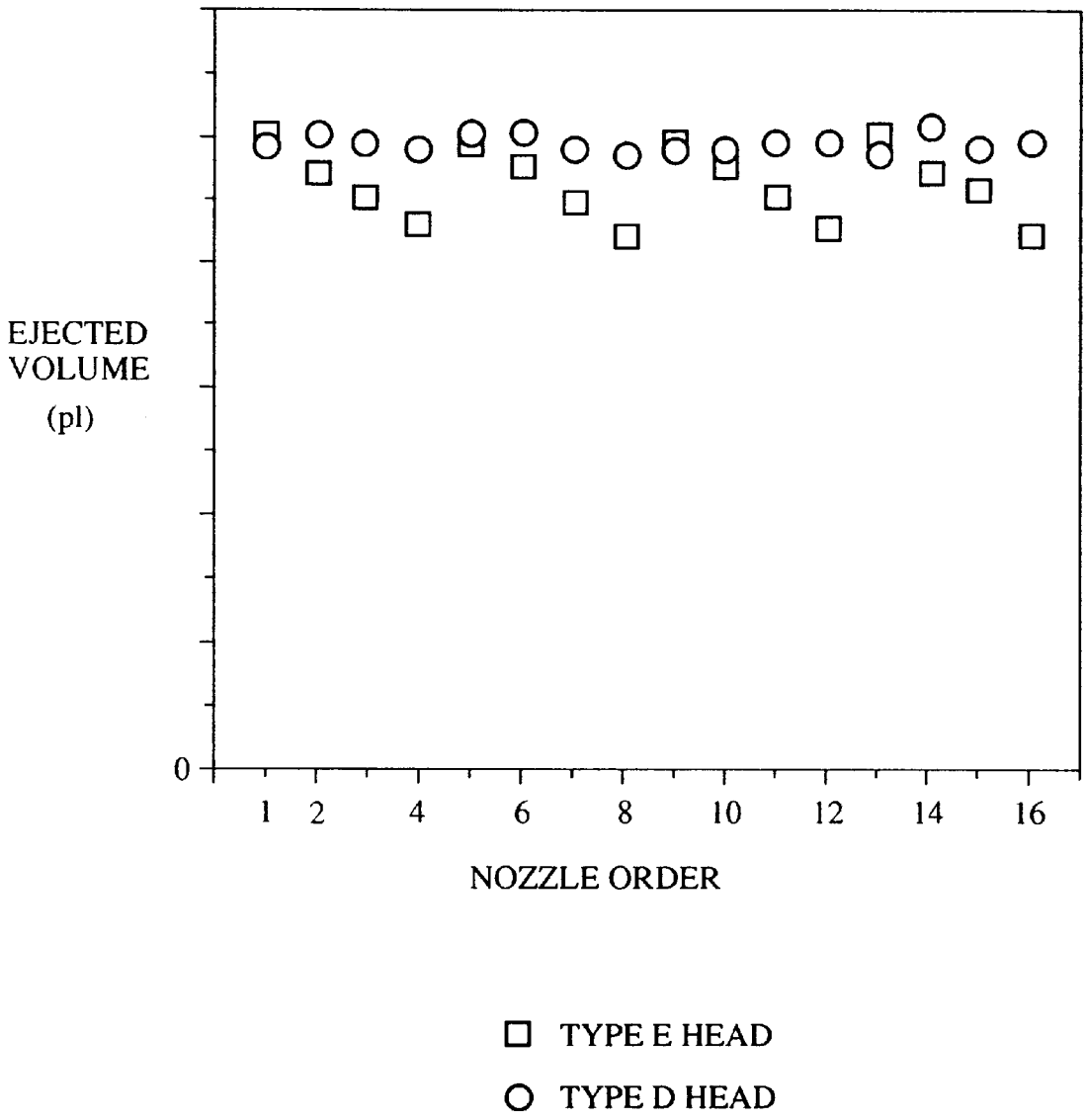
FIG. 25 is a graph showing the result of comparison between the printing head of the present invention and the conventional printing head with respect to the volume of ink droplets ejected when the head is driven at a high frequency.

FIG. 25 is a graph showing the relationship between the order of the nozzles of the type D printing head and the type E printing head used in Experimental Example 7 and the volumes of ink droplets (ejected ink volumes) ejected through outlets of these printing heads under the same conditions as in Experimental Example 7 with respect to the heater 6 driving order and times. In the type E printing head, the ejected volumes are reduced with respect to the driving order by the influence of crosstalk. In the type D printing head, crosstalk cannot occur easily, so that variations in ejected volume are small.

From these results, it can be understood that the printing head having the channel structure in accordance with the present invention can stabilize the ejected ink volume to maintain the performance for obtaining high-quality printed images.

EXPERIMENTAL EXAMPLE 9

For realization of stable high-speed printing and maintenance of the performance for obtaining high-quality printed images, it is desirable that no crosstalk occurs when the printing head is driven. Then, it is desirable to reduce variations in the ejected ink velocity due to crosstalk. The type D printing head and the type E printing head were driven at the same driving frequency for high-speed driving to eject ink, and the velocity of ink ejected from these printing heads was measured and compared.

Figure 26:
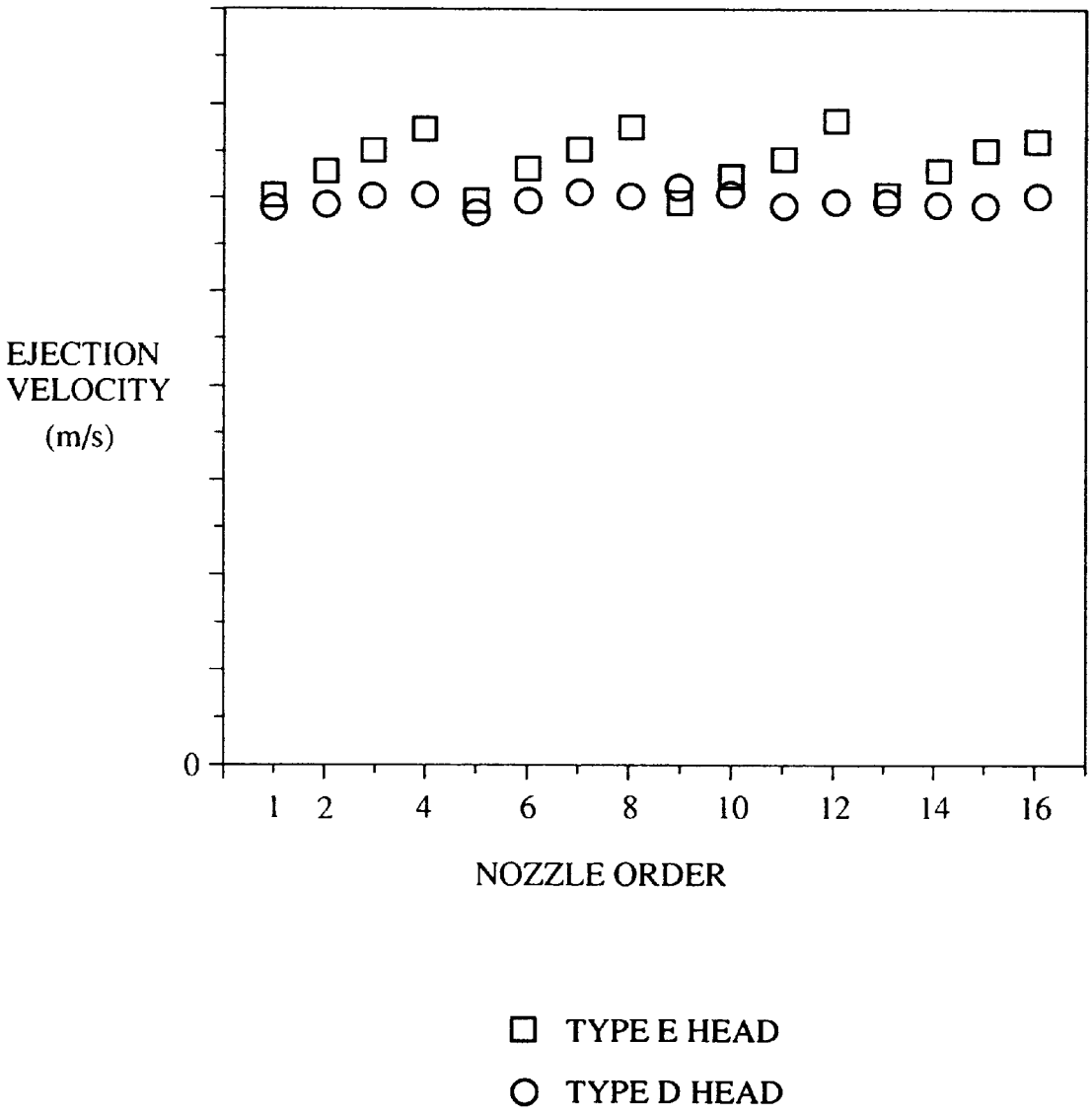
FIG. 26 is a graph showing the result of comparison between the printing head of the present invention and the conventional printing head with respect to the velocity of ink droplets ejected when the head is driven at a high frequency.

FIG. 26 is a graph showing the relationship between the order of the outlets of the type D printing head and the type E printing head used in Experimental Example 7 (the same nozzle order as that in Experimental Example 8) and the velocities of ink droplets (ejected ink velocities) ejected through outlets of these printing heads under the same conditions as in Experimental Example 7 with respect to the heater 6 driving order and times. In the type E printing head, the ejected ink velocities are increased with respect to the driving order by the influence of occurrence of crosstalk. In the type D printing head, crosstalk cannot occur easily, so that variations in ejected ink velocity are small.

From these results, it can be understood that the printing head having the channel structure in accordance with the present invention can stabilize the ejected ink velocity to maintain the performance for obtaining high-quality printed images.

The advantages of the D type head have been described in comparison with the E-type head. In the D type head, however, occurrence of crosstalk can be further reduced and high-speed recording can be achieved by using a particular driving method.

With respect to a head having a construction such as that shown in FIG. 21 and having a pair of channels having a common communication port to the common liquid, such a driving method may be a method of energizing heaters in each pair of channels substantially simultaneously and sequentially energizing the groups of heaters in the pairs of channels, or a method of energizing one of two heaters in each pair of channels and energizing one of the heaters in another pair of channels so that the two heaters in each pair of channels are not driven successively.

Figure 27:
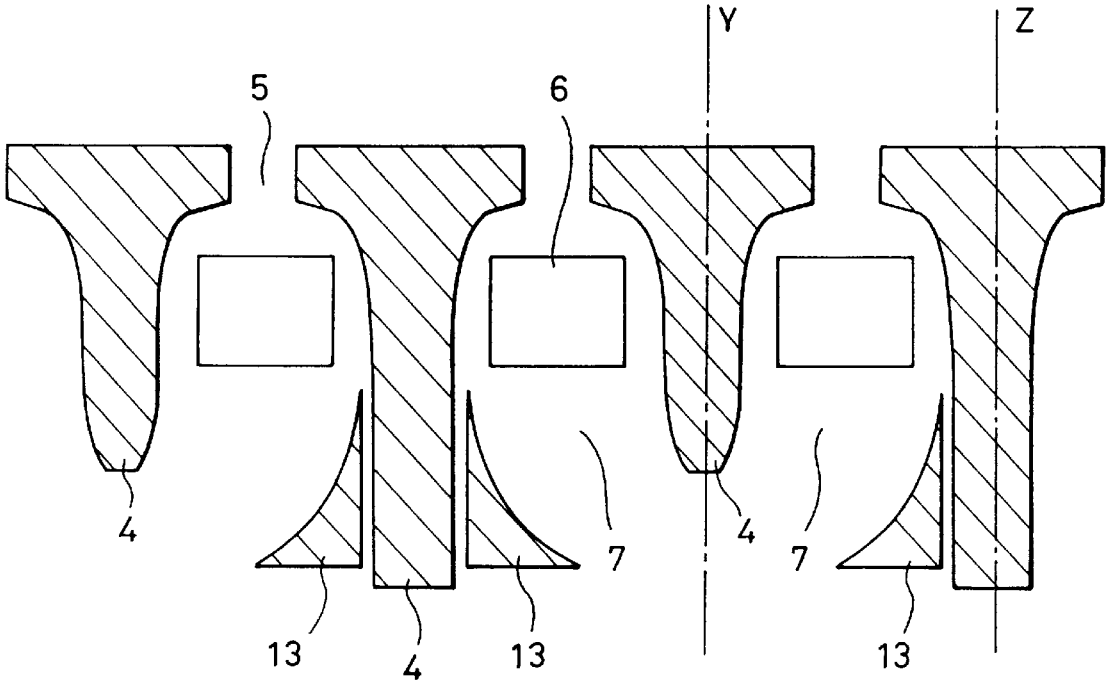
FIG. 27 is a plan view of the ink channel structure of a tenth embodiment of the liquid-jet printing head in accordance with the present invention.

FIG. 27 shows a tenth embodiment of the present invention. In this embodiment, an ink flow changing member 13 is provided independently of channel wall members 4 to form an ink flow asymmetrically in a region around a heater 6 in each of channels 7. This structure is advantageous in that an asymmetrical flow of ink in each channel 7 about a bubble can be realized more effectively by using a small structural member, and that a larger pressure difference in a region around a bubble can therefore be controlled. It is therefore possible to provide a liquid-jet printing head having a long life through which improved ink ejection stability is maintained to obtain high-quality printed images, and capable of performing printing at a high speed.

Figure 28:
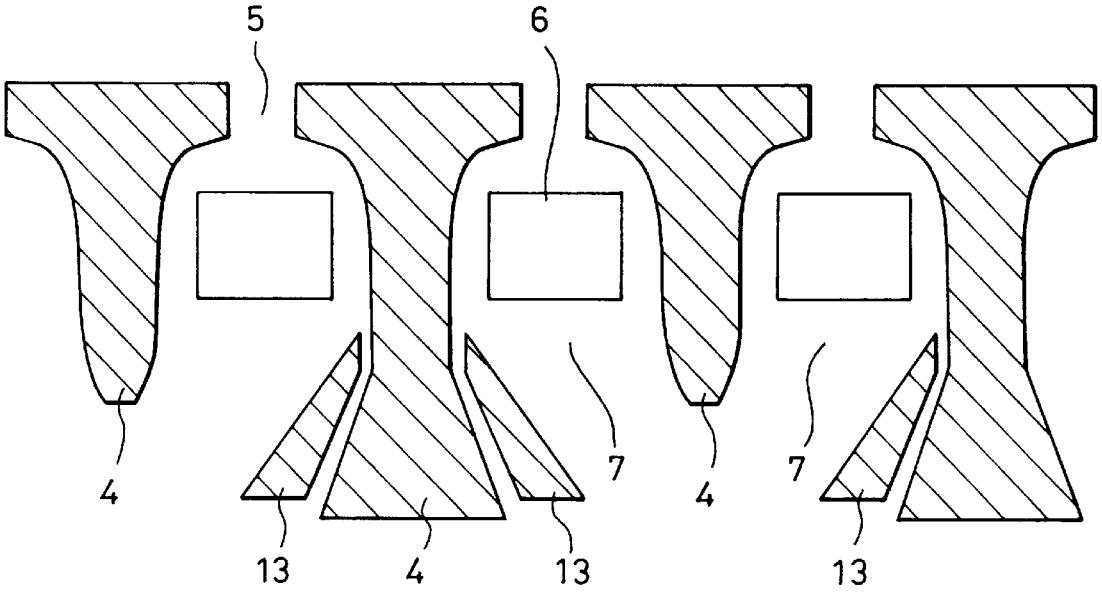
FIG. 28 is a plan view of the ink channel structure in an eleventh embodiment of the liquid-jet printing head in accordance with the present invention.

FIG. 28 shows an eleventh embodiment of the present invention. In this embodiment, channel wall members 4 and an ink flow changing member 13 separate from the channel wall members are used to form a wing-like sectional configuration such that a further asymmetry is created in an asymmetric ink flow formed in each of channels 7. This structure is advantageous in that the pressure difference caused in a region around a bubble 10 by an ink flow formed asymmetrically in each channel 7 can be further increased by changing the ink flow. It is therefore possible to provide a liquid-jet printing head having a long life through which improved ink ejection stability is maintained to obtain high-quality printed images, and capable of performing printing at a high speed.

Figure 29:
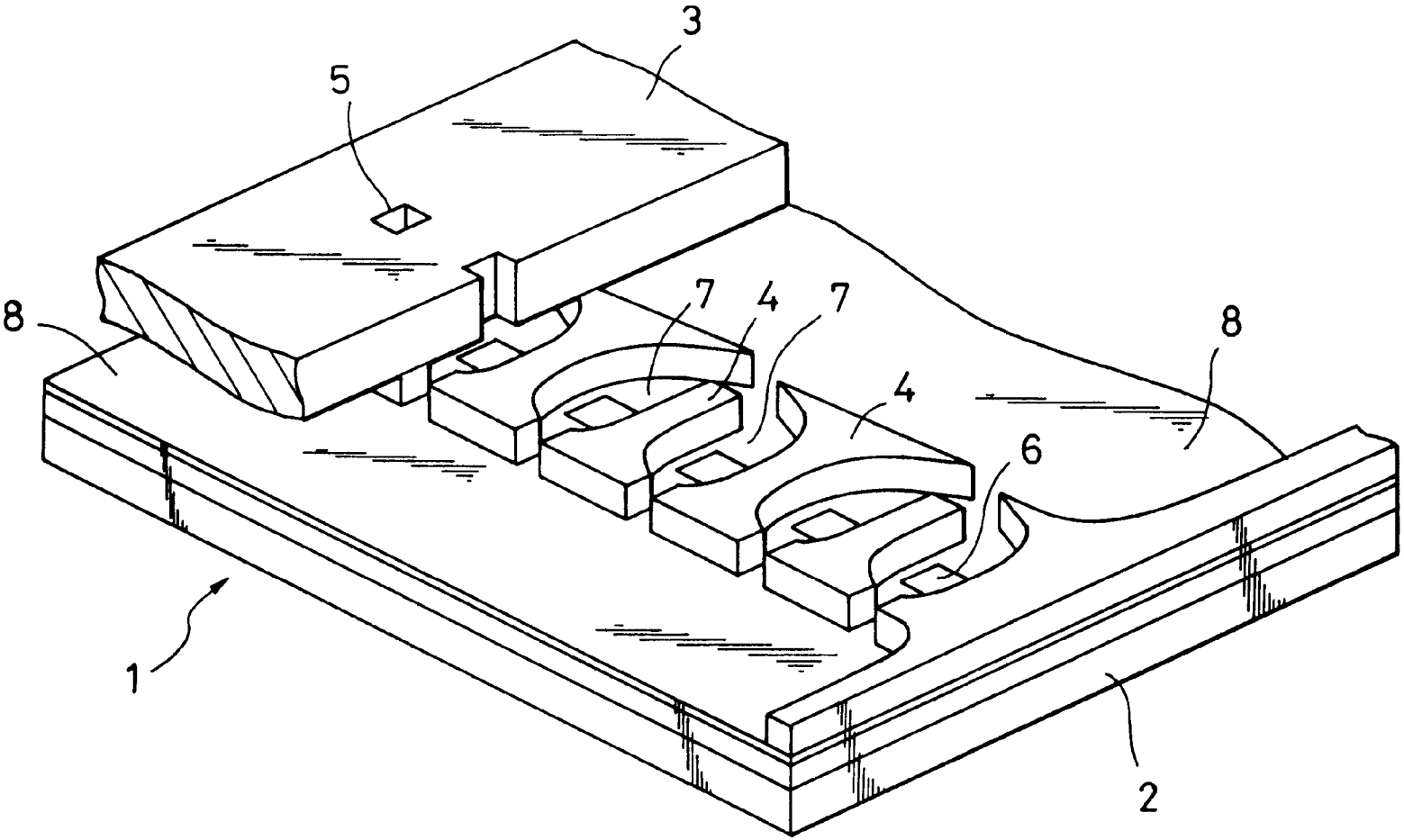
FIG. 29 is a perspective view of a twelfth embodiment of the liquid-jet printing head in accordance with the present invention.

FIG. 29 shows a twelfth embodiment of the present invention. In this embodiment, an example of a printing head structure is adopted which comprises the channel structure shown in FIG. 21, and in which the surface of each heater 6 and the opening surface of the corresponding outlet 5 are disposed parallel to each other.

Figure 30:
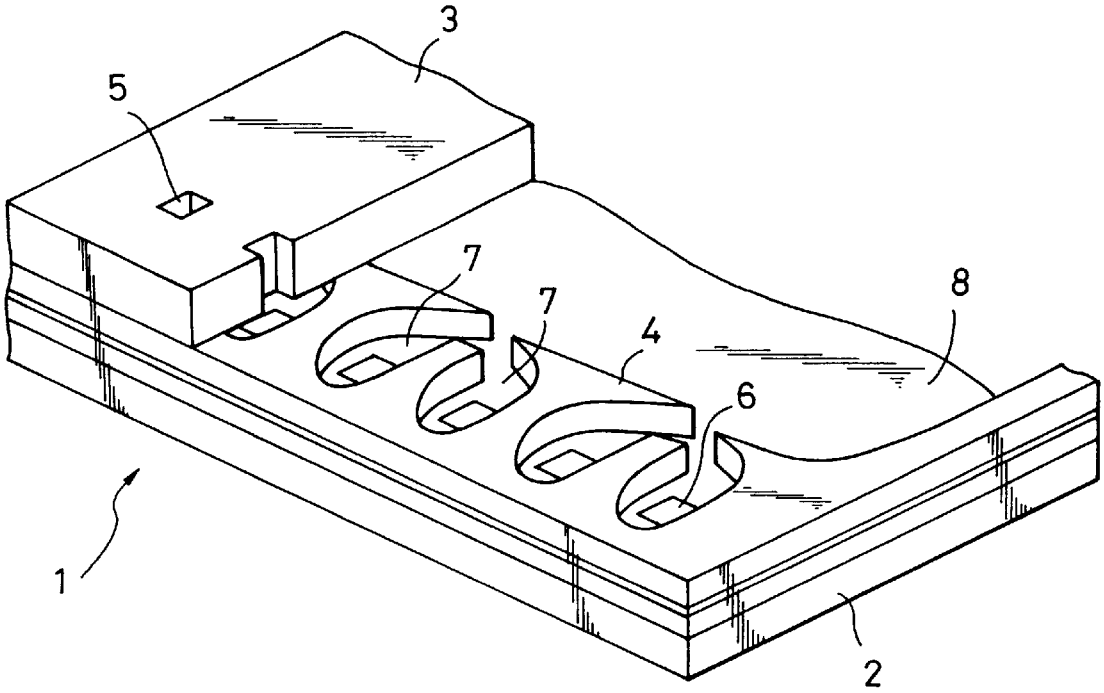
FIG. 30 is a perspective view of a thirteenth embodiment of the liquid-jet printing head in accordance with the present invention.

FIG. 30 shows a thirteenth embodiment of the present invention. In this embodiment, an example of a printing head structure is adopted in which a wing-like space is formed around each heater 6 by channel wall members 4, and in which the surface of the heater 6 and the opening surface of the corresponding nozzle 5 are disposed parallel to each other.

The arrangement of each of the printing heads shown in FIGS. 29 and 30 has the same effect as that of the printing head having the configuration shown in FIG. 20, making it possible to provide a liquid-jet printing head having a long life through which improved ejection stability can be maintained to obtain high-quality printed images, and capable of performing printing at a high speed.

The present invention is not limited to the structure around the channels described above with respect to the embodiments. Any other liquid channel structures may be used as long as they do not depart from the scope of the invention. Also, the shape, position and number of flow changing members are not limited to those described above.

Figure 31:
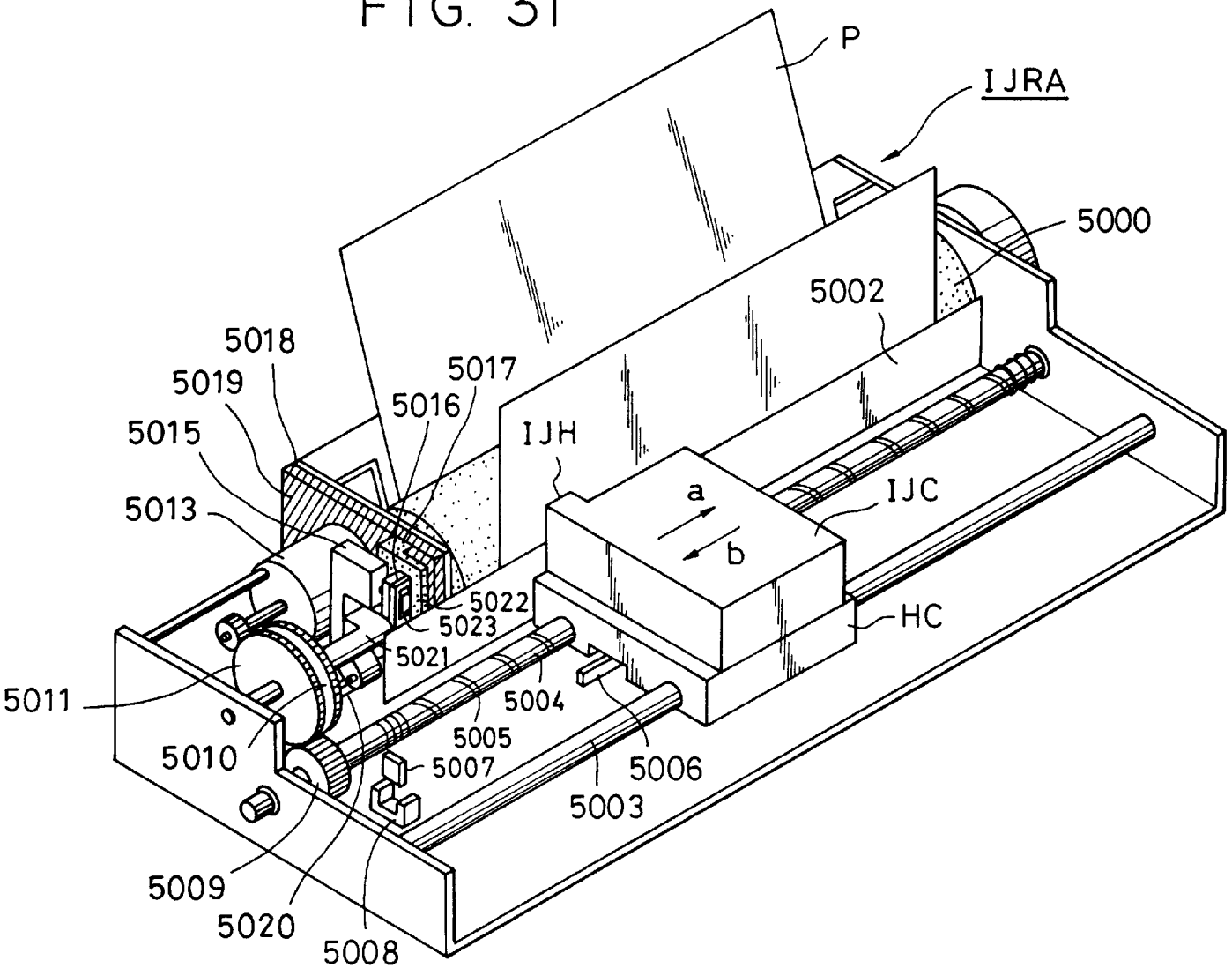
FIG. 31 is a perspective view of an internal construction of a printing apparatus in accordance with the present invention.

FIG. 31 shows the construction of an embodiment of an ink jet recording apparatus (printing apparatus) in accordance with the present invention. The apparatus has a guide shaft 5003 for guiding a carriage HC in the directions of arrows a and b, and a lead screw 5005 in which a spiral groove 5004 is formed. The carriage HC is moved in the direction of arrow a or b along the guide shaft 5003 by normal or reverse rotation of the lead screw 5005. During the movement of the carriage HC, ink is jetted to recording medium P, such as paper, cloth or an overhead projector sheet, from an ink jet head (printing head) of an ink jet head cartridge IJC mounted on the carriage HC.

A platen 5000 constitutes a recording medium transport means for transporting the recording medium. A carriage driving motor 5013 and gears 5009 and 5011 for transmitting a driving force of the driving motor 5013 to the lead screw 5005 are provided. A sheet pressing plate 5002 serves to press the recording medium against the platen 5000 and also constitutes the recording medium transport means. The apparatus of this embodiment also includes a cap member 5022 having an opening 5023 and capable of covering an ejection surface formation member (not shown) of an ink jet head IJH, an attraction means 5015 linked to the cap member 5022 and having a function of absorbing ink from the head IJH through the cap member 5022 during a recovery operation, cleaning blade 5017 used before and after the recovery operation, and a supporting member 5016 for supporting the cap member 5022. The cleaning blade 5017 is moved in the direction of the arrow by a member 5019 to wipe the ejection surface of the head.

A lever 5021 serves to drive the attraction means 5015 through a gear 5010 and a cam 5020. A driving force is transmitted from the driving motor 5013 to the lever 5021 through a clutch changeover means (not shown) and the above-mentioned transmission means. Photocouplers 5007 and 5008 are provided to detect a home position of the carriage HC. Photocouplers 5007 and 5008 detect the home position of the carriage HC to change the normal/reverse rotation of the driving motor 5013 when their optical path is obstructed by a lever 5006 provided on the carriage HC.

In this embodiment, the apparatus is arranged so that each of capping, cleaning and attraction recovery can be effected at a corresponding position by a well-known timing by the operation of the lead screw 5005 when the carriage HC moves into a home position region. However, the apparatus may have any other arrangement as long as the desired operation is performed by a well-known timing, although the arrangement of this embodiment is preferred in accordance with the present invention.

This printing apparatus also has electrical signal supply means for supplying electrical signals for driving the printing head to the printing head.

The present invention can be applied effectively to a printing head and a printing apparatus using a particular ink jet printing system having a means for generating thermal energy as energy utilized to eject ink (e.g., electrothermal transducer, laser light or the like) and arranged to cause a change in the state of ink by thermal energy thereby generated. By using this system, high-density high-resolution printing can be achieved.

For example, as a typical example of such a system, a system based on the fundamental principles described in the specification of U.S. Pat. Nos. 4,723,129 and 4,740,796 is preferably used. This system can be applied to either of on-demand type and continuous type of printing apparatuses. If this system is applied to an on-demand type, at least one drive signal for causing an abrupt increase in the temperature of a liquid (ink) exceeding a temperature rise causing nucleate boiling in accordance with printing information is applied to an electrothermal transducer facing a sheet or channel containing the liquid to generate thermal energy in the electrothermal transducer, whereby film boiling is caused in the thermal action surface of the printing head. As a result, a bubble can be formed in the liquid (ink) corresponding to the drive signal in a one-to-one relationship. Therefore, an application to an on-demand type of printing apparatus is particularly effective. The liquid (ink) is ejected through an ejection opening by the growth and collapse of such a bubble to form at least one liquid droplet. It is preferable to form the drive signal as a pulse-like signal, because a bubble can be instantaneously grown and collapsed in a suitable manner so that the response of liquid (ink) ejection is improved. As such a pulse-like drive signal, a drive signal such as that described in the specification of U.S. Pat. No. 4,463,359 or U.S. Pat. No. 4,345,262 is suited. If the condition of the increase in the temperature of the above-mentioned thermal action surface described in the specification of U.S. Pat. No. 4,313,124 is adopted, the printing performance can be further improved.

Further, the present invention can be applied effectively to a full-line type of printing head having a length corresponding to a maximum width of printing medium sheets usable in a printing apparatus. Such a printing head may be constructed by combining a plurality of printing heads so as to have such a length, or may be constructed as one integrally-formed printing head.

The present invention can also be applied effectively to a serial type of printing head such as that described above, a printing head fixed to the apparatus body, an interchangeable chip type of printing head which can be electrically connected to the apparatus body and which can be supplied with ink from the apparatus body when mounted in the apparatus body, and a cartridge type of printing head integrally combined with an ink tank.

It is preferable to add a printing head ejection recovery means, an auxiliary preparatory means and the like to the printing apparatus of the present invention, because the effect of the present invention can be further stabilized thereby. Such means are, for example, means for capping the printed head, a cleaning means, a pressurization or attraction means, a means for preliminary heating using an electrothermal transducer, a heating device different from the transducer or a combination of the transducer and the heating device, and a preliminary ejection means for effecting ejection other than that for printing.

The kind and the number of printed heads mounted may be selected as desired. For example, only one head may be provided for monochromatic printing, or a plurality of means may be provided in correspondence with a plurality of inks differing in printing color and density. That is, the present invention is highly effective for a printing apparatus having at least one of a printing mode for multi-color printing in two or more colors and a printing mode for full-color printing using mixed colors, regardless of whether one integrally-constructed printing head or a combination of a plurality of printing heads, are used as well as for a printing apparatus having only a printing mode for printing in a popularly-used color such as black.

The embodiments of the present invention have been described by assuming that the ink used is a liquid. However, an ink which can solidify at a temperature equal to or lower than room temperature and which softens or liquefies at room temperature may also be used. Also, an ink having a liquid form when an operating printing signal is applied may be used since in ordinary liquid jet systems the temperature of ink is controlled in the range of 30 to 70° C. so that the viscosity of ink is within a stable ejection range. Further, an ink which solidifies when being left in a certain condition and which liquefies when heated may be used for the purpose of preventing an undesirable increase in temperature by positively utilizing it as energy for a change in the state of ink from a solid state to a liquid state, or for the purpose of preventing evaporation of ink. In any cases, the present invention can be applied to an arrangement using an ink having such a property as to be liquefied only when thermal energy is applied, e.g., an ink which is liquefied by application of thermal energy in accordance with a printing signal to be ejected in a liquid form, and which may start solidifying when it reaches a printing medium. In accordance with the present invention, the above-described film boiling system is most effective if one of such inks is used.

The liquid-jet printing apparatus of the present invention may be formed as a printing apparatus used as an image output terminal for information processors such as computers, a copying machine combined with a reader or the like, or a facsimile apparatus having transmitting and receiving functions.

According to the present invention, as described above, each of the printing liquid channels of the liquid-jet printing head is formed so as to define a space having a generally-wing-like sectional configuration as its sectional configuration parallel to the substrate. The configuration of this space is such that, in a region around a bubble of the printing liquid caused by the thermal energy transducer in the printing liquid channel, a force in accordance with the Kutta-Joukowski theorem is caused by a flow of the printing liquid formed when the printing liquid channel is refilled with the printing liquid. The flow of the printing liquid about the bubble is thereby formed asymmetrically so that a pressure imbalance is created in a region around the bubble. A force is thereby applied to the bubble in a direction intersecting the main direction of the flow of the printing liquid from the common liquid chamber toward the nozzle when the channel is refilled with the printing liquid, thereby preventing the erosion action of cavitation collapse pressure caused when the bubble collapses from being concentrated at the thermal energy transducer.

Moreover, the erosion action upon the thermal energy transducer is dispersively distributed, so that deposits on a larger area of the thermal energy transducer can be separated from the thermal energy transducer. Therefore, the instability of energy transmission to the printing liquid is reduced and high-quality printed images can be obtained stably for a long time.

According to the present invention, the combination of the internal configuration of the printing liquid channel of the liquid-jet printing head from the thermal energy transducer to the outlet for ejecting the printing liquid and a printing liquid flow changing member provided upstream of the thermal transducer (on the side of the chamber containing the printing liquid) may also be selected to cause a pressure imbalance in a region around a bubble generated by the thermal energy transducer in the printing liquid channel. A force is thereby applied to the bubble in a direction intersecting the main direction of the flow of the printing liquid from the common liquid chamber toward the outlet when the channel is refilled with the printing liquid, thereby preventing the erosion action of cavitation collapse pressure caused when the bubble collapses from being concentrated at the thermal energy transducer.

Further, according to the present invention, the arrangement may be such that each printing liquid channel and another adjacent printing liquid channel form a pair having one of two liquid channel wall members as a common wall, and the common wall is shorter than the other liquid channel wall members, thereby forming a printing liquid channel structure for reducing the refilling time. This structure and a particular driving method may be combined to achieve high-speed printing.

Consequently, according to the present invention, it is possible to provide a liquid-jet printing head having a long life and capable of stably obtaining high-quality images with at a high speed and a liquid-jet printing apparatus in which the liquid-jet printing head is mounted.

Also, the printing head driving method makes it possible to limit crosstalk and to stably perform high-speed recording.

While the present invention has been described with respect to what presently are considered to be preferred embodiments, it is to be understood that the invention is not limited to the disclosed embodiments. To the contrary, the present invention is intended to cover various modifications and equivalent arrangements included within the spirit and scope of the appended claims.

What is claimed is:

1. A printing head for performing printing by ejecting a liquid, comprising:

a substrate;

a plurality of outlets;

a common liquid chamber for supplying a liquid;

a plurality of heating resistor elements each for generating a bubble in the liquid by applying heat to the liquid, the liquid being ejected through an associated said outlet by the generation of the bubble, said heating resistor elements being disposed on said substrate; and a plurality of asymmetrical liquid channels defined by a plurality of channel walls provided on said substrate in correspondence with and containing said heating resistor elements, each communicating with an associated said outlet and with said common liquid chamber, each of said liquid channels being shaped asymmetrically about a centerline in a direction of ink flow through said liquid channel of said heating resistor element contained therein so that each of said liquid channels has a substantially-wing-like profile in a vicinity of said heating resistor contained therein when viewed looking perpendicular to a plane which is parallel to said substrate, the substantially-wing-like profile affecting flow of the liquid into each said liquid channel so that a sidewards force is applied to the bubble as the bubble collapses in a direction which is not parallel to a line extending from the common liquid chamber toward the corresponding said outlet.

2. A printing head according to claim 1, wherein the length of one of a pair of liquid channel wall members forming each of said liquid channels having the wing-like profile is larger than that of the other of the pair of liquid channel wall members.

3. A printing head according to claim 1, wherein the sectional configuration of each of said liquid channels having the wing-like sectional configuration parallel to said substrate is asymmetrical.

4. A printing head according to claim 1, wherein each of said liquid channels is formed by a pair of liquid channel wall members, each of adjacent pairs of said liquid channels form a pair having one of the pair of liquid channel wall members as a common wall member, and each adjacent pair of liquid chambers form a symmetrical configuration about the common wall member.

5. A printing head according to claim 1, wherein said liquid channels are formed by alternately arranging two types of liquid channel wall members differing in length from each other.

6. A printing head according to claim 1, wherein each of said liquid channels is formed by two liquid channel wall members disposed on said substrate, one of the two liquid channel wall members having a planar shape, the other of the two liquid channel wall members having such a shape as to form the liquid channel profile as a wing-like profile.

7. A printing head according to claim 1, wherein the wing-like profile is formed by a liquid flow changing member provided in the liquid channel.

8. A printing head according to claim 1, wherein the bubble is generated by film boiling of the liquid caused by heat from the heating resistor element.

9. A printing head according to claim 1, wherein the liquid comprises ink.

10. A printing apparatus for performing printing on a recording medium by ejecting a liquid onto the recording medium, comprising:

a printing head according to any one of claims 1 to 9; and electrical signal supply means for supplying electrical signals for energizing said heating resistor members.

11. A printing apparatus for performing printing by ejecting a liquid, comprising:

a printing head according to any one of claims 1 to 9; and transport means for transporting a recording medium.

12. A method of driving a printing head having heating resistor elements for applying heat to a liquid and liquid channels formed in correspondence with the heating resistor elements, said method comprising the steps of:

providing a printing head having a plurality of heating resistor elements each for generating a bubble in the liquid by applying heat to the liquid, the liquid being ejected through an outlet by the formation of the bubble, a substrate on which the heating resistor elements are disposed, and asymmetrical liquid channels provided on the substrate in correspondence with the heating resistor elements and communicating with the outlet and with a common liquid chamber for supplying the liquid, each of the liquid channels being formed asymmetrically about a centerline in a direction of ink flow through said liquid channel of said heating resistor element contained therein to have a substantially-wing-like sectional configuration as its sectional configuration in the vicinity of the heating resistor contained therein parallel to the substrate, the substantially-wing-like sectional configuration being such that a sidewards force is applied to the bubble in a direction intersecting a direction from the common liquid chamber toward the corresponding outlet;

generating heat by applying an electrical signal to at least one of the heating resistor elements;

generating a bubble in the liquid by the heat generated by the application of the electrical signal, and ejecting the liquid through an outlet communicating with the corresponding liquid chamber; and applying the sidewards force to the bubble, by as a consequence of the substantially-wing-like sectional configuration of the liquid channel, in the direction intersecting the direction from a common liquid chamber toward the corresponding outlet by a flow of the liquid when the liquid channel is refilled with the liquid from the common liquid chamber simultaneously with a collapse of the bubble.

13. A method of printing on a recording medium by ejecting a liquid onto the recording medium, comprising the steps of:

providing a printing head according to claim 4; and energizing the heating resistor elements corresponding to the liquid channels forming said pair substantially simultaneously, so that at least some of said heating resistor elements generate heat.

14. A method of printing on a recording medium by ejecting a liquid onto the recording medium, comprising the steps of:

providing a printing head according to claim 4; and energizing the heating resistor elements corresponding to the liquid channels forming said pair after the liquid has been ejected through another adjacent pair of liquid channels, so that at least some of the heating resistor elements generate heat.

15. A printing head for performing printing by ejecting a liquid, comprising:

a substrate;

a plurality of outlets;

a common liquid chamber for supplying a liquid;

a plurality of heating resistor elements each for generating a bubble in the liquid by applying heat to the liquid, the liquid being ejected through an associated said outlet by the generation of the bubble, said heating resistor elements being disposed on said substrate; and a plurality of asymmetrical liquid channels defined by a plurality of channel walls provided on said substrate in correspondence with and containing said heating resistor elements, each communicating with an associated said outlet and with said common liquid chamber, each of said liquid channels being shaped asymmetrically about a centerline in a direction of ink flow through said liquid channel of said heating resistor element contained therein so that each of said liquid channels has a substantially-wing-like profile in a vicinity of said heating resistor contained therein when viewed looking perpendicular to a plane which is parallel to said substrate, wherein a profile of each of said liquid channels having the wing-like profile parallel to said substrate is asymmetrical such as to exert a sidewards force on the bubble generated.

16. A printing head according to claim 15, wherein the length of one of a pair of liquid channel wall members forming each of said liquid channels having the wing-like profile is larger than that of the other of the pair of liquid channel wall members.

17. A printing head according to claim 15, wherein each of said liquid channels is formed by a pair of liquid channel wall members, each of adjacent pairs of said liquid channels form a pair having one of the pair of liquid channel wall members as a common wall member, and each adjacent pair of liquid chambers form a symmetrical configuration about the common wall member.

18. A printing head according to claim 15, wherein said liquid channels are formed by alternately arranging two types of liquid channel wall members differing in length from each other.

19. A printing head according to claim 15, wherein each of said liquid channels is formed by two liquid channel wall members disposed on said substrate, one of the two liquid channel wall members having a planar shape, the other of the two liquid channel wall members having such a shape as to form the liquid channel profile as a wing-like profile.

20. A printing head according to claim 15, wherein the wing-like profile is formed by a liquid flow changing member provided in the liquid channel.

21. A printing head according to claim 15, wherein the bubble is generated by film boiling of the liquid caused by heat from the heating resistor element.

22. A printing head according to claim 15, wherein the liquid comprises ink.

23. A printing apparatus for performing printing on a recording medium by ejecting a liquid onto the recording medium, comprising:

a printing head according to any one of claims 15 to 22; and electrical signal supply means for supplying electrical signals for energizing said heating resistor members.

24. A printing apparatus for performing printing on a recording medium by ejecting a liquid onto the recording medium, comprising:

a printing head according to any one of claims 15 to 22; and transport means for transporting a recording medium.

* * * * *

UNITED STATES PATENT AND TRADEMARK OFFICE

CERTIFICATE OF CORRECTION

PATENT NO. : 6,053,599
DATED : April 25, 2000
INVENTOR(S) : Hiroyuki Maeda

It is certified that error appears in the above-identified patent and that said Letters Patent is hereby corrected as shown below:

Column 2,
Line 28, "of" (first occurrence) should be deleted.

Column 7,
Line 7, "droplets" should read -- droplet -- .

Column 8,
Lines 10, 34 and 61, "other ten" should read -- ten other --.

Column 10,
Line 31, "6" (second occurrence) should be deleted;
Line 59, "FIGS. 11(C)" should read -- FIGS. 11(c) --.

Column 21,
Line 9, "by" should be deleted.

Signed and Sealed this

Fourth Day of December, 2001

*Attest:*

Nicholas P. Godici

*Attesting Officer*

NICHOLAS P. GODICI
*Acting Director of the United States Patent and Trademark Office*